US011225075B2

(12) United States Patent
Nakagawa et al.

(10) Patent No.: US 11,225,075 B2
(45) Date of Patent: Jan. 18, 2022

(54) LIQUID EJECTION HEAD, LIQUID EJECTION MODULE, AND LIQUID EJECTION APPARATUS

(71) Applicant: CANON KABUSHIKI KAISHA, Tokyo (JP)

(72) Inventors: Yoshiyuki Nakagawa, Kawasaki (JP); Akiko Hammura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/789,800

(22) Filed: Feb. 13, 2020

(65) Prior Publication Data

US 2020/0262200 A1 Aug. 20, 2020

(30) Foreign Application Priority Data

Feb. 19, 2019 (JP) ..... JP2019-027392
Jun. 5, 2019 (JP) ..... JP2019-105339

(51) Int. Cl.
*B41J 2/14* (2006.01)

(52) U.S. Cl.
CPC ..... *B41J 2/14145* (2013.01); *B41J 2/14201* (2013.01); *B41J 2002/14419* (2013.01)

(58) Field of Classification Search
CPC ..... B41J 2/14145; B41J 2/14201; B41J 2002/14419; B41J 2202/21; B41J 2202/11; B41J 2202/12; B41J 2/1404; B41J 2202/20; B41J 2/14016; B41J 2/14032
See application file for complete search history.

(56) References Cited

U.S. PATENT DOCUMENTS

| | | | |
|---|---|---|---|
| 6,109,735 | A | 8/2000 | Kashino et al. |
| 6,164,763 | A | 12/2000 | Sugama et al. |
| 6,595,625 | B2 | 7/2003 | Sugama et al. |
| 8,721,051 | B2 | 5/2014 | Kobayashi et al. |
| 10,538,087 | B2 | 1/2020 | Nakagawa et al. |

(Continued)

FOREIGN PATENT DOCUMENTS

| | | | |
|---|---|---|---|
| CN | 1179383 | A | 4/1998 |
| CN | 102189798 | A | 9/2011 |

(Continued)

OTHER PUBLICATIONS

IP.com search (Year: 2021).*

(Continued)

*Primary Examiner* — Lisa Solomon
(74) *Attorney, Agent, or Firm* — Venable LLP

(57) ABSTRACT

In a liquid ejection head, a substrate includes a first inflow port which is located on an upstream side of a pressure chamber in a flow direction of liquids in a liquid flow passage and allows a first liquid to flow into the liquid flow channel, a second inflow port which is located on the upstream side of the first inflow port and allows a second liquid to flow into the liquid flow passage, and a confluence wall provided between the first inflow port and the second inflow port and having a portion at a higher position than a surface of the substrate on a downstream side of the first inflow port in the flow direction. In the pressure chamber, the first liquid flows in contact with a pressure generating element and the second liquid flows closer to an ejection port than the first liquid does.

18 Claims, 16 Drawing Sheets

(56) References Cited

U.S. PATENT DOCUMENTS

| | | | |
|---|---|---|---|
| 10,576,741 | B2 | 3/2020 | Hammura et al. |
| 2002/0012026 | A1 | 1/2002 | Kubota et al. |
| 2019/0009554 | A1 | 1/2019 | Nakagawa |
| 2019/0023016 | A1 | 1/2019 | Nakagawa et al. |
| 2020/0039210 | A1 | 2/2020 | Nakagawa et al. |
| 2020/0039218 | A1 | 2/2020 | Nakagawa et al. |
| 2020/0039219 | A1 | 2/2020 | Nakagawa et al. |
| 2020/0039223 | A1 | 2/2020 | Nakagawa et al. |

FOREIGN PATENT DOCUMENTS

| | | | |
|---|---|---|---|
| CN | 103287101 | A | 9/2013 |
| CN | 109203678 | A | 1/2019 |
| EP | 1 005 988 | A2 | 6/2000 |
| JP | 06-305143 | A | 11/1994 |

OTHER PUBLICATIONS

Extended European Search Report dated Jun. 24, 2020, in European Patent Application No. 20158223.6.
U.S. Appl. No. 16/682,120, Yoshiyuki Nakagawa Kazuhiro Yamada Takuro Yamazaki Toru Nakakubo Ryo Kasai, filed Nov. 13, 2019.
U.S. Appl. No. 16/793,223, Yoshiyuki Nakagawa Akiko Hammura Shinji Kishikawa, filed Feb. 18, 2020.
Office Action dated Oct. 19, 2021, in Chinese Patent Application No. 202010100784.0.

* cited by examiner

LIQUID EJECTION HEAD, LIQUID EJECTION MODULE, AND LIQUID EJECTION APPARATUS

BACKGROUND OF THE DISCLOSURE

Field of the Disclosure

This disclosure relates to a liquid ejection head, a liquid ejection module, and a liquid ejection apparatus.

Description of the Related Art

Japanese Patent Laid-Open No. H06-305143 discloses a liquid ejection unit configured to bring a liquid serving as an ejection medium and a liquid serving as a bubbling medium into contact with each other at an interface, and to eject the ejection medium along with growth of a bubble generated in the bubbling medium as a consequence of imparting thermal energy. Japanese Patent Laid-Open No. H06-305143 also discloses formation of a flow by applying a pressure to one or both of the ejection medium and the bubbling medium.

However, Japanese Patent Laid-Open No. H06-305143 lacks a detailed description of a configuration of a confluence unit for the two types of liquids. Accordingly, depending on the shape of an inflow portion for a liquid to flow into a liquid flow passage inclusive of a pressure chamber, an interface may be formed across which the bubbling medium and the ejection medium flow side by side in a width direction (horizontal direction) orthogonal to a direction of flow of the liquids in the liquid flow passage. In this case, there is a risk of unstable ejection of the liquid serving as the ejection medium because the liquid serving as the ejection medium may fail to come into contact with an ejection port.

SUMMARY OF THE DISCLOSURE

In view of the above circumstances, this disclosure aims to stabilize ejection of a liquid serving as an ejection medium by causing a liquid serving as a bubbling medium and the liquid serving as the ejection medium to flow while being arranged in a height direction in a pressure chamber, the height direction being a direction of ejection of the liquid serving as the ejection medium from an ejection port.

A liquid ejection head according to an aspect of this disclosure includes a substrate including a pressure generating element configured to apply pressure to a first liquid, a member provided with an ejection port configured to eject a second liquid, a pressure chamber including the ejection port and the pressure generating element; and a liquid flow passage formed by using the substrate and the member, the liquid flow passage including the pressure chamber and allowing at least the first liquid and the second liquid to flow. Here, the substrate includes a first inflow port located on an upstream side of the pressure chamber in a direction of flow of the liquids in the liquid flow passage and configured to allow the first liquid to flow into the liquid flow passage, a second inflow port located on the upstream side of the first inflow port and configured to allow the second liquid to flow into the liquid flow passage, and a wall provided between the first inflow port and the second inflow port and having a portion located at a higher position than a surface of the substrate on a downstream side of the first inflow port in the direction of flow of the liquids in the liquid flow channel. In the pressure chamber, the first liquid flows in contact with the pressure generating element and the second liquid flows closer to the ejection port than the first liquid does.

Further features of the present invention will become apparent from the following description of exemplary embodiments with reference to the attached drawings.

DESCRIPTION OF THE EMBODIMENTS

Now, liquid ejection heads and liquid ejection apparatuses according to embodiments of this disclosure will be described below with reference to the drawings.

First Embodiment (Configuration of Liquid Ejection Head)

Figure 1:
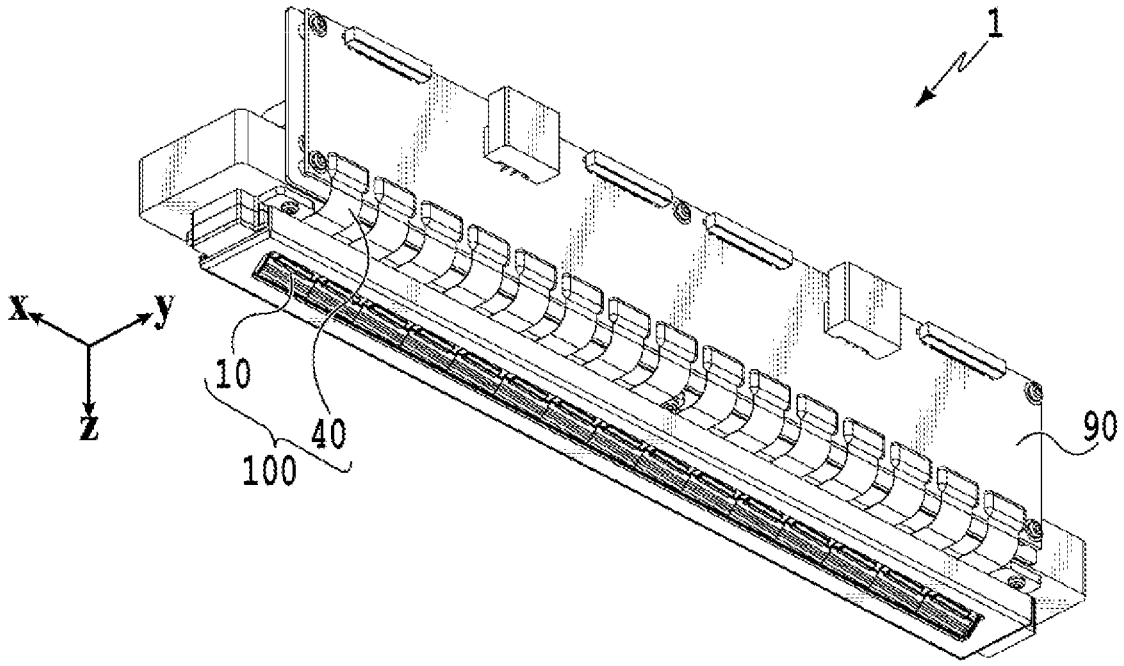
FIG. 1 is a perspective view of a liquid ejection head.

FIG. 1 is a perspective view of a liquid ejection head 1 usable in this embodiment. The liquid ejection head 1 of this embodiment is formed by arranging multiple liquid ejection modules 100 (arraying multiple modules) in an x direction. Each liquid ejection module 100 includes an element board 10 on which ejection elements are arranged, and a flexible wiring board 40 for supplying electric power and ejection signals to the respective ejection elements. The respective flexible wiring boards 40 are connected to an electric wiring board 90 used in common, which is provided with arrays of power supply terminals and ejection signal input terminals. Each liquid ejection module 100 is easily attachable to and detachable from the liquid ejection head 1. Accordingly, any desired liquid ejection module 100 can be easily attached from outside to or detached from the liquid ejection head 1 without having to disassemble the liquid ejection head 1.

Given the liquid ejection head 1 formed by the multiple arrangement of the liquid ejection modules 100 in a longitudinal direction as described above, even if a certain one of the ejection elements causes an ejection failure, only the liquid ejection module involved in the ejection failure needs to be replaced. Thus, it is possible to improve a yield of the liquid ejection heads 1 during a manufacturing process thereof, and to reduce costs for replacing the head.

(Configuration of Liquid Ejection Apparatus)

Figure 2:
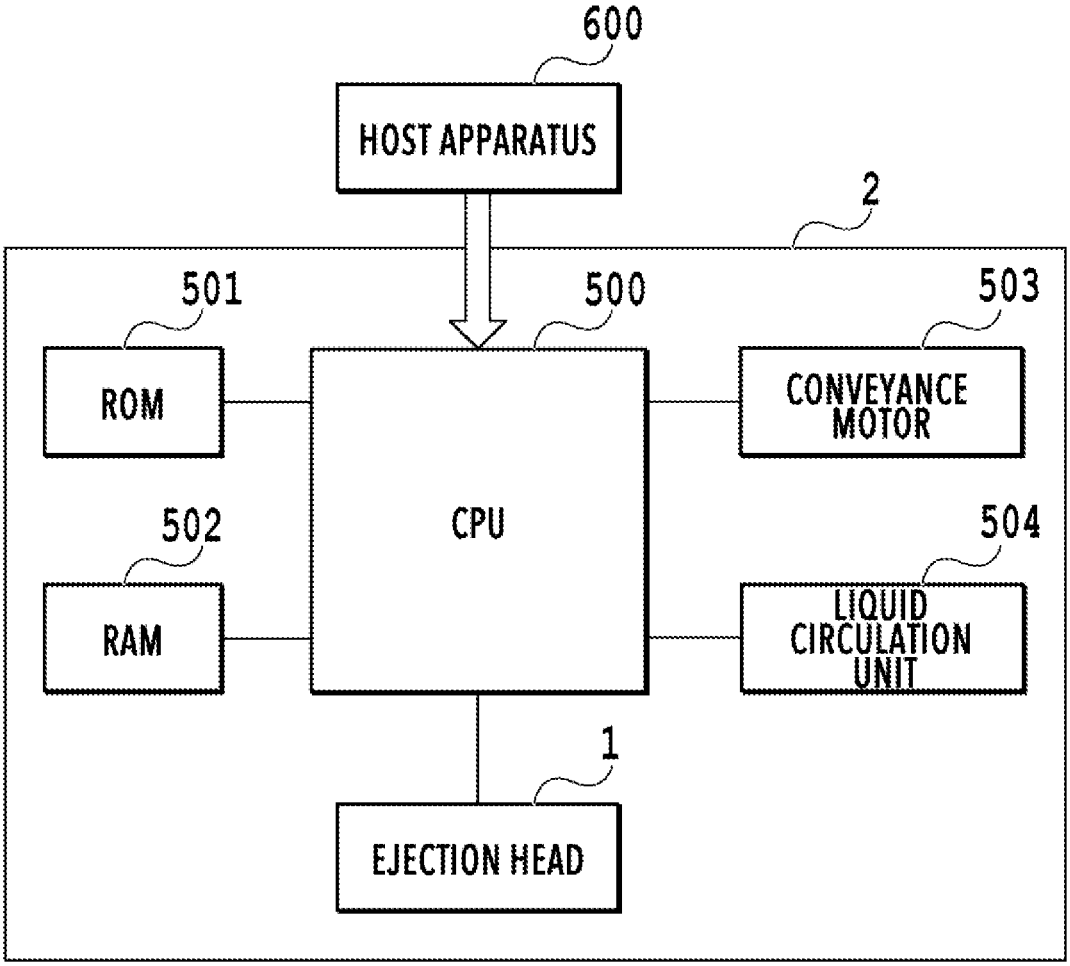
FIG. 2 is a block diagram for explaining a control configuration of a liquid ejection apparatus.

FIG. 2 is a block diagram showing a control configuration of a liquid ejection apparatus 2 usable in this embodiment. A CPU 500 controls the entire liquid ejection apparatus 2 in accordance with programs stored in a ROM 501 while using a RAM 502 as a work area. The CPU 500 performs prescribed data processing in accordance with the programs and parameters stored in the ROM 501 on ejection data to be received from an externally connected host apparatus 600, for example, thereby generating the ejection signals for causing the liquid ejection head 1 to eject a liquid. Then, the liquid ejection head 1 is driven in accordance with the ejection signals while a target medium for depositing the liquid is moved in a predetermined direction by driving a conveyance motor 503. Thus, the liquid ejected from the liquid ejection head 1 is deposited on the deposition target medium for adhesion.

A liquid circulation unit 504 is a unit configured to circulate and supply the liquid to the liquid ejection head 1 and to conduct flow rate control of the liquid in the liquid ejection head 1. The liquid circulation unit 504 includes a sub-tank to store the liquid, a flow passage for circulating the liquid between the sub-tank and the liquid ejection head 1, pumps, a valve mechanism, and so forth. Hence, under the instruction of the CPU 500, the liquid circulation unit 504 controls the pumps and the valve mechanism such that the liquid flows in the liquid ejection head 1 at a predetermined flow rate.

(Configuration of Element Board)

Figure 3:
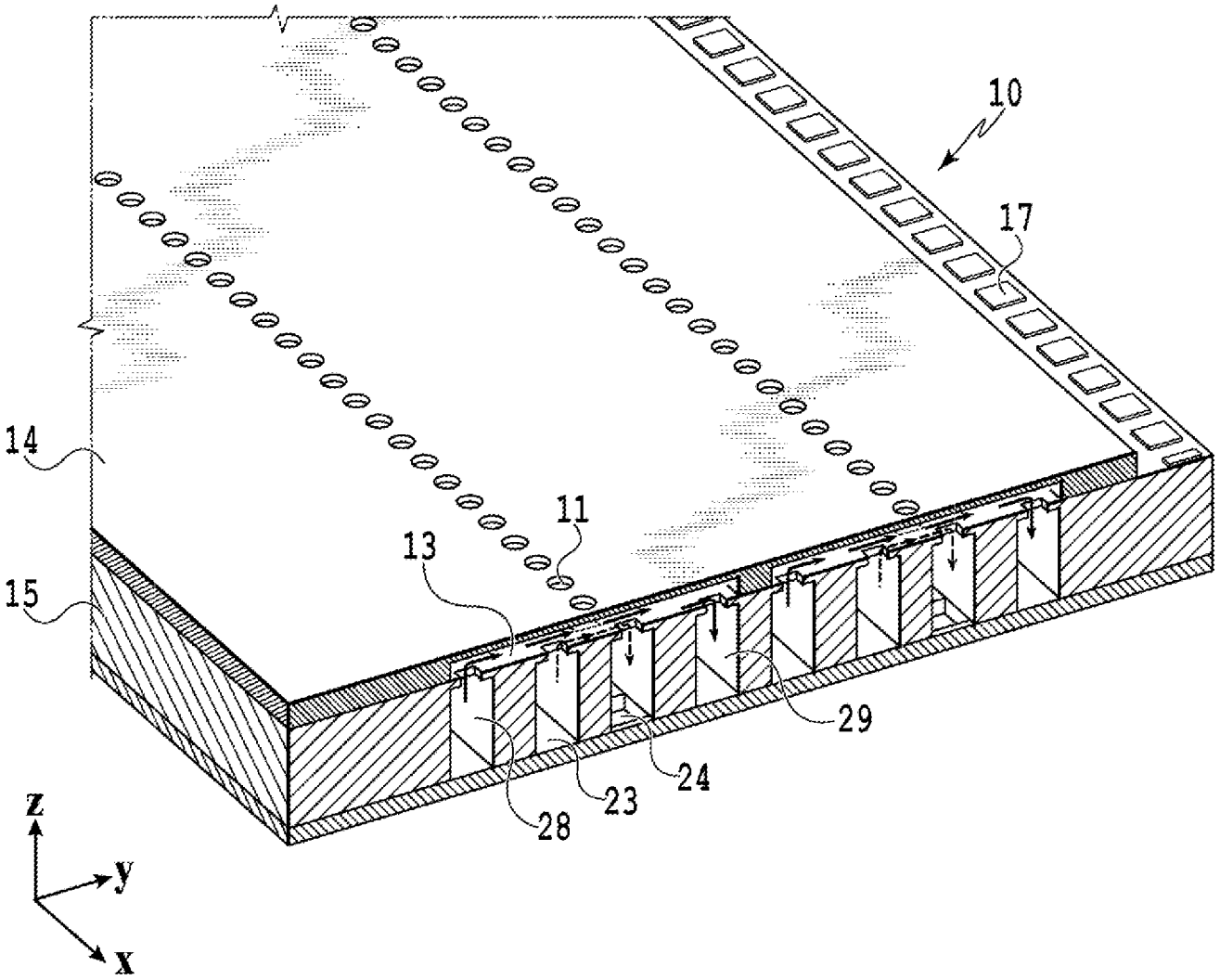
FIG. 3 is a cross-sectional perspective view of an element board in a liquid ejection module.

FIG. 3 is a cross-sectional perspective view of the element board 10 provided in each liquid ejection module 100. The element board 10 is formed by stacking an orifice plate (an ejection port forming member) 14 on a silicon (Si) substrate 15. In the orifice plate 14, multiple ejection ports 11 for ejecting liquid are arranged in the x direction. In FIG. 3, the ejection ports 11 arranged in the x direction eject the liquid of the same type (such as a liquid supplied from a common sub-tank or a common supply port). FIG. 3 illustrates an example in which the orifice plate 14 is also provided with liquid flow passages 13. Instead, the element board 10 may adopt a configuration in which the liquid flow passages 13 are formed by using a different component (a flow passage wall forming member) and the orifice plate 14 provided with the ejection ports 11 is placed thereon.

Pressure generating elements 12 (not shown in FIG. 3 but shown in FIGS. 4A to 4D) are disposed at positions on the substrate 15 corresponding to the respective ejection ports 11. Each ejection port 11 and the corresponding pressure generating element 12 are located at such positions that are opposed to each other. In a case where a voltage is applied to the pressure generating element 12 in response to an ejection signal, the pressure generating element 12 applies a pressure to the liquid in a z direction orthogonal to a flow direction (a y direction) of the liquid. Accordingly, the liquid is ejected in the form of a droplet from the ejection port 11 opposed to the pressure generating element 12. The flexible wiring board 40 supplies the electric power and driving signals to the pressure generating elements 12 via terminals 17 arranged on the substrate 15.

The multiple liquid flow passages 13 which extend in the y direction and are connected to the ejection ports 11, respectively, are formed in the orifice plate 14. Meanwhile, the liquid flow passages 13 arranged in the x direction are connected to a first common supply flow passage 23, a first common collection flow passage 24, a second common supply flow passage 28, and a second common collection flow passage 29 in common. Flows of liquids in the first common supply flow passage 23, the first common collection flow passage 24, the second common supply flow passage 28, and the second common collection flow passage 29 are controlled by the liquid circulation unit 504 described with reference to in FIG. 2. To be more precise, the pump is subjected to such drive control that a first liquid flowing from the first common supply flow passage 23 into the liquid flow passages 13 is directed to the first common collection flow passage 24 while a second liquid flowing from the second common supply flow passage 28 into the liquid flow passages 13 is directed to the second common collection flow passage 29.

FIG. 3 illustrates an example in which the ejection ports 11 and the liquid flow passages 13 arranged in the x direction as described above, and the first and second common supply flow passages 23 and 28 as well as the first and second common collection flow passages 24 and 29 used in common for supplying and collecting inks to and from these ports and passages are defined as a set, and two sets of these constituents are arranged in the y direction.

(Configurations of Liquid Flow Passage and Pressure Chamber)

Figure 4A:
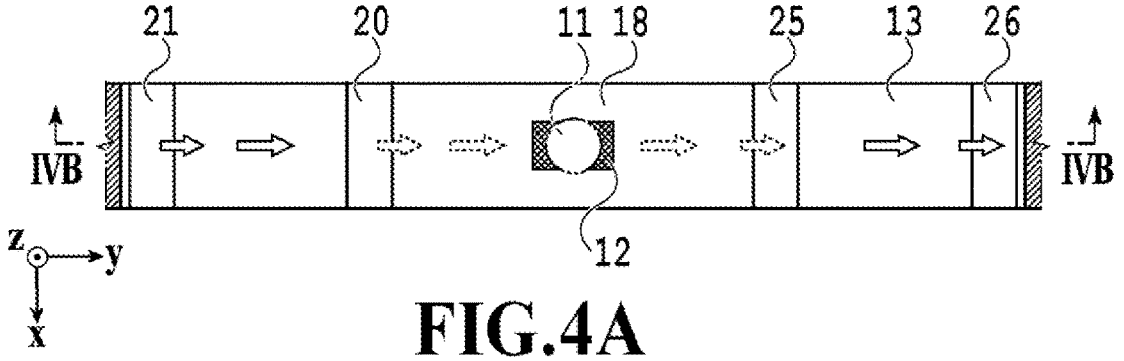
FIGS. 4A to 4C are drawings showing a liquid flow passage formed in the element board and FIG. 4D is an enlarged detail drawing of a pressure chamber.
Figure 4B:
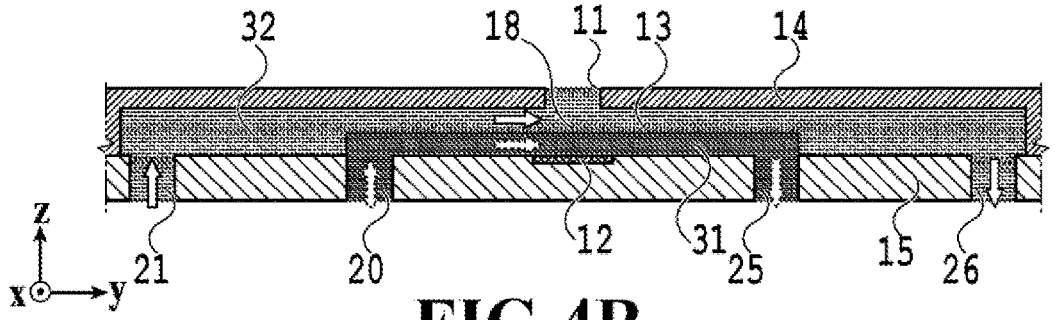
Figure 4C:
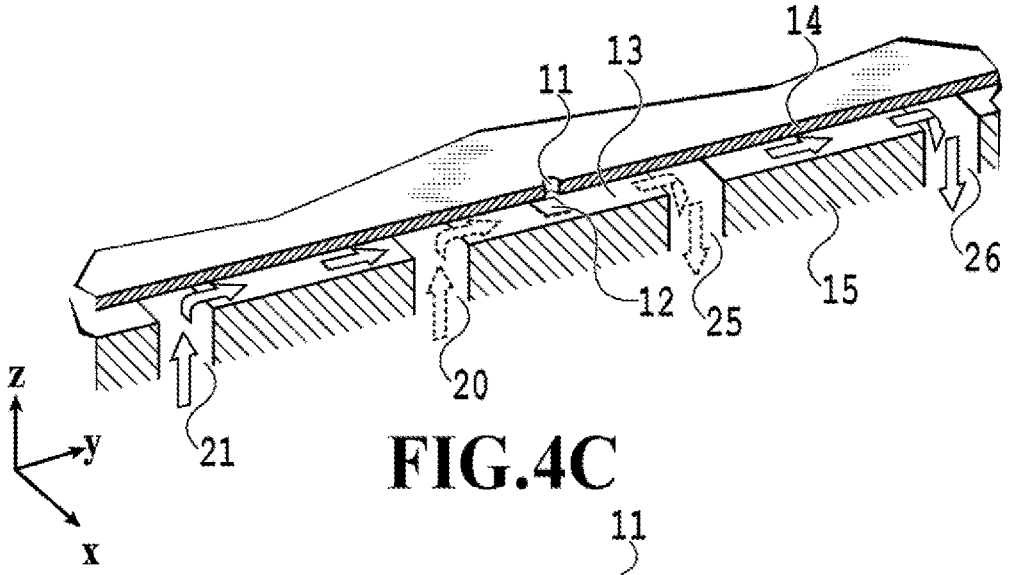
Figure 4D:
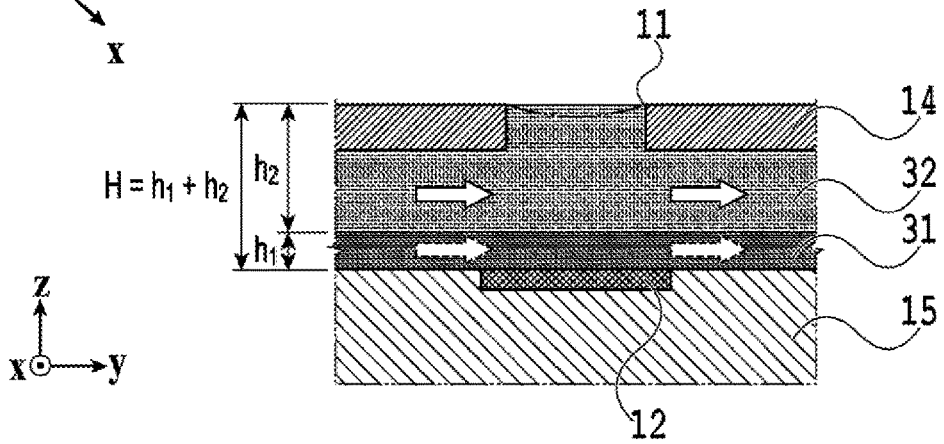

FIGS. 4A to 4D are diagrams for explaining configurations of each liquid flow passage 13 and of each pressure chamber 18 formed in the element board 10 in detail. FIG. 4A is a perspective view from the ejection port 11 side (from a +z direction side) and FIG. 4B is a cross-sectional view taken along the IVB-IVB line in FIG. 4A. Meanwhile, FIG. 4C is an enlarged diagram of the neighborhood of one of the liquid flow passages 13 in the element board shown in FIG. 3, and FIG. 4D is an enlarged diagram of the neighborhood of the ejection port in FIG. 4B.

The substrate 15 corresponding to a bottom portion of the liquid flow passage 13 includes a second inflow port 21, a first inflow port 20, a first outflow port 25, and a second outflow port 26, which are formed in this order in the y direction. Moreover, the pressure chamber 18 including the ejection port 11 and the pressure generating element 12 is located substantially at the center between the first inflow port 20 and the first outflow port 25 in the liquid flow passage 13. The second inflow port 21 is connected to the second common supply flow passage 28, the first inflow port 20 is connected to the first common supply flow passage 23, the first outflow port 25 is connected to the first common collection flow passage 24, and the second outflow port 26 is connected to the second common collection flow passage 29, respectively (see FIG. 3).

Under the above-described configuration, a first liquid 31 supplied from the first common supply flow passage 23 to the liquid flow passage 13 through the first inflow port 20 flows in the y direction (a direction indicated with arrows), then passes through the pressure chamber 18 and is collected by the first common collection flow passage 24 through the first outflow port 25. Meanwhile, a second liquid 32 supplied from the second common supply flow passage 28 to the liquid flow passage 13 through the second inflow port 21 flows in the y direction (the direction indicated with arrows), then passes through the pressure chamber 18 and is collected by the second common collection flow passage 29 through the second outflow port 26. In other words, both of the first liquid and the second liquid flow in the y direction in a section of the liquid flow passage 13 between the first inflow port 20 and the first outflow port 25.

In the pressure chamber 18, the pressure generating element 12 is in contact with the first liquid 31 while the second liquid 32 exposed to the atmosphere forms a meniscus in the vicinity of the ejection port 11. The first liquid 31 and the second liquid 32 flow in the pressure chamber 18 such that the pressure generating element 12, the first liquid 31, the second liquid 32, and the ejection port 11 are arranged in this order. Specifically, assuming that the pressure generating element 12 is located on a lower side and the ejection port 11 is located on an upper side, the second liquid 32 flows above the first liquid 31. Moreover, the first liquid 31 is pressurized by the pressure generating element 12 located below and at least the second liquid 32 is ejected upward from the bottom. Note that this up-down direction corresponds to a height direction of the pressure chamber 18 and of the liquid flow passage 13.

In this embodiment, flow rates of the first liquid 31 and of the second liquid 32 are adjusted in accordance with physical properties of the first liquid 31 and the second liquid 32 such that the first liquid 31 and the second liquid 32 flow in contact with each other in the pressure chamber as shown in FIG. 4D. The flows of the two liquids include not only parallel flows shown in FIG. 4D in which the two liquids flow in the same direction, but also flows of the liquids in which the flow of the first liquid crosses the flow of the second liquid. In the following, the parallel flows out of these flows will be described as an example.

In the case of the parallel flows, it is preferable to keep an interface between the first liquid 31 and the second liquid 32 from being disturbed, or in other words, to establish a state of laminar flows inside the pressure chamber 18 with the flows of the first liquid 31 and the second liquid 32. Specifically, in the case of an attempt to control an ejection performance so as to maintain a predetermined amount of ejection, for instance, it is preferable to drive the pressure generating element in a state where the interface is stable. Nevertheless, this embodiment is not limited only to this configuration. Even if the interface between the two liquids in the pressure chamber 18 gets unstable, the pressure generating element 12 may still be driven in a state where at least the first liquid flows mainly on the pressure generating element 12 side and the second liquid flows mainly on the ejection port 11 side. The following description will be mainly focused on the example where the flows in the pressure chamber are in the state of parallel flows and in the state of laminar flows.

(Conditions to Form Parallel Flows in Concurrence with Laminar Flows)

Conditions to form laminar flows of liquids in a tube will be described to begin with. The Reynolds number Re to represent a ratio between viscous force and interfacial tension has been generally known as a flow evaluation index.

Now, a density of a liquid is defined as ρ, a flow velocity thereof is defined as u, a representative length thereof is defined as d, and a viscosity is defined as η. In this case, the Reynolds number Re can be expressed by the following (formula 1):

$$Re=\rho ud/\eta \qquad \text{(formula 1).}$$

Here, it is known that the laminar flows are more likely to be formed as the Reynolds number Re becomes smaller. To be more precise, it is known that flows inside a circular tube are formed into laminar flows in the case where the Reynolds number Re is smaller than some 2200 and the flows inside the circular tube become turbulent flows in the case where the Reynolds number Re is larger than some 2200, for example.

In the case where the flows are formed into the laminar flows, flow lines become parallel to a traveling direction of the flows without crossing each other. Accordingly, in the case where the two liquids in contact constitute the laminar flows, the liquids can form the parallel flows with the stable interface between the two liquids. Here, in view of a general inkjet printing head, a height H [μm] of the flow passage (the height of the pressure chamber) in the vicinity of the ejection port in the liquid flow passage (the pressure chamber) is in a range from about 10 to 100 μm. In this regard, in the case where water (density $\rho=1.0\times10^3$ kg/m$^3$, viscosity $\eta=1.0$ cP) is fed to the liquid flow passage of the inkjet printing head at a flow velocity of 100 mm/s, the Reynolds number Re turns out to be $Re=\rho ud/\eta\approx0.1\sim1.0<<2200$. As a consequence, the laminar flows can be deemed to be formed therein.

Here, even if the liquid flow passage 13 and the pressure chamber 18 have rectangular cross-sections as shown in FIG. 4A, the liquid flow passage 13 and the pressure chamber 18 can be treated like in the case of the circular tube, or more specifically, an effective form of the liquid flow passage 13 or the pressure chamber 18 can be deemed as the diameter of the circular tube.

(Theoretical Conditions to Form Parallel Flows in State of Laminar Flows)

Next, conditions to form the parallel flows with the stable interface between the two types of liquids in the liquid flow passage 13 and the pressure chamber 18 will be described with reference to FIG. 4D. First, a distance from the substrate 15 to an ejection port surface of the orifice plate 14 is defined as H [μm]. Then, a distance between the ejection port surface and a liquid-liquid interface between the first liquid 31 and the second liquid 32 (a phase thickness of the second liquid) is defined as $h_2$ [μm], and a distance between the liquid-liquid interface and the substrate 15 (a phase thickness of the first liquid) is defined as $h_1$ [μm]. In other words, an equation $H=h_1+h_2$ holds true.

Here, as for boundary conditions in the liquid flow passage 13 and the pressure chamber 18, velocities of the liquids on wall surfaces of the liquid flow passage 13 and the pressure chamber 18 are assumed to be zero. Moreover, velocities and shear stresses of the first liquid 31 and the second liquid 32 at the liquid-liquid interface are assumed to have continuity. Based on the assumption, if the first liquid 31 and the second liquid 32 form two-layered and parallel steady flows, then a quartic equation as defined in the following (formula 2) holds true in a section of the parallel flows:

$$\begin{aligned}&(\eta_1-\eta_2)(\eta_1Q_1+\eta_2Q_2)h_1^4+2\eta_1H\{\eta_2(3Q_1+Q_2)-\\&\quad 2\eta_1Q_1\}h_1^3+3\eta_1H^2\{2\eta_1Q_1-\eta_2(3Q_1+Q_2)\}h_1^2+\\&\quad 4\eta_1Q_1H^3(\eta_2-\eta_1)h_1+\eta_1^2Q_1H^4=0\end{aligned} \qquad \text{(formula 2).}$$

In the (formula 2), $\eta_1$ represents the viscosity of the first liquid 31, $\eta_2$ represents the viscosity of the second liquid 32, $Q_1$ represents the flow rate of the first liquid 31, and $Q_2$ represents the flow rate of the second liquid 32, respectively. In other words, the first liquid and the second liquid flow so as to establish a positional relationship in accordance with the flow rates and the viscosities of the respective liquids within such ranges to satisfy the above-mentioned quartic equation (formula 2), thereby forming the parallel flows with the stable interface. In this embodiment, it is preferable to form the parallel flows of the first liquid and the second liquid in the liquid flow passage 13 or at least in the pressure chamber 18. In the case where the parallel flows are formed as mentioned above, the first liquid and the second liquid are only involved in mixture due to molecular diffusion on the liquid-liquid interface therebetween, and the liquids flow in parallel in the y direction virtually without causing any mixture. Note that the flows of the liquids do not always have to establish the state of laminar flows in a certain region in the pressure chamber 18. In this context, at least the flows of the liquids in a region above the pressure generating element preferably establish the state of laminar flows.

Even in the case of using immiscible solvents such as oil and water as the first liquid and the second liquid, for example, the stable parallel flows are formed regardless of the immiscibility as long as the (formula 2) is satisfied. Meanwhile, even in the case of oil and water, if the interface is disturbed due to a state of slight turbulence of the flows in the pressure chamber, it is preferable that at least the first liquid flows mainly above the pressure generating element and the second liquid flows mainly in the ejection port.

Figure 5A:
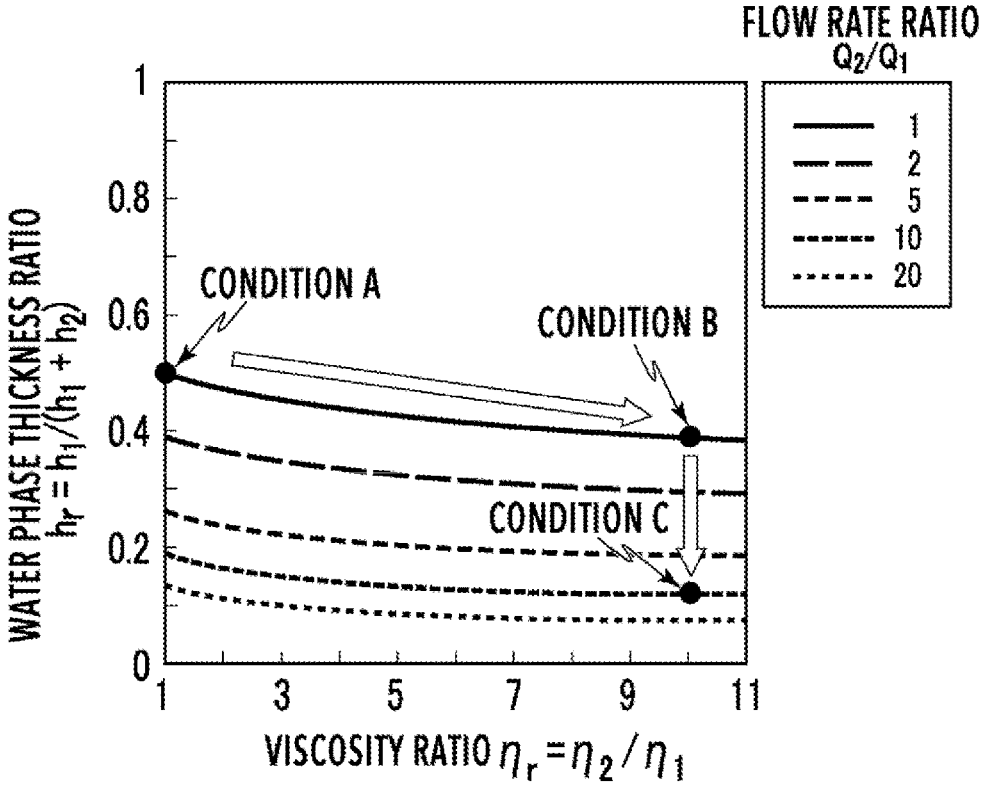
FIG. 5A is a graph showing a relation between a viscosity ratio and a water phase thickness ratio and FIG. 5B is a graph showing a relation between a height of the pressure chamber and a flow velocity.

FIG. 5A is a graph representing a relation between a viscosity ratio $\eta_r=\eta_2/\eta_1$ and a phase thickness ratio $h_r=h_1/(h_1+h_2)$ of the first liquid while changing a flow rate ratio $Q_r=Q_2/Q_1$ to several levels based on the (formula 2). Although the first liquid is not limited to water, the "phase thickness ratio of the first liquid" will be hereinafter referred to as a "water phase thickness ratio". The horizontal axis indicates the viscosity ratio $\eta_r=\eta_2/\eta_1$ and the vertical axis indicates the water phase thickness ratio $h_r=h_1/(h_1+h_2)$, respectively. The water phase thickness ratio $h_r$ becomes lower as the flow rate ratio $Q_r$ grows higher. Meanwhile, at each level of the flow rate ratio $Q_r$, the water phase thickness ratio $h_r$ becomes lower as the viscosity ratio $\eta_r$ grows higher. Therefore, the water phase thickness ratio $h_r$ (corresponding to the position of the interface between the first liquid and the second liquid) in the liquid flow passage 13 (the pressure chamber) can be adjusted to a desired value by controlling the viscosity ratio $\eta_r$ and the flow rate ratio $Q_r$ between the first liquid and the second liquid. In addition, in the case where the viscosity ratio $\eta_r$ is compared with the flow rate ratio $Q_r$, FIG. 5A teaches that the flow rate ratio $Q_r$ has a larger impact on the water phase thickness ratio $h_r$ than the viscosity ratio $\eta_r$ does.

Here, as for the water phase thickness ratio $h_r=h_1/(h_1+h_2)$, the parallel flows of the first liquid and the second liquid are presumably formed in the liquid flow passage (the pressure chamber) as long as $0<h_r<1$ (condition 1) is satisfied. However, as described later, the first liquid is caused to function mainly as the bubbling medium while the second liquid is caused to function mainly as the ejection medium so as to stabilize a ratio between the first liquid end and the second liquid contained in ejected droplets to a desired value. In consideration of this situation, the water phase thickness ratio $h_r$ is preferably set equal to or below 0.8 (condition 2) or more preferably set equal to or below 0.5 (condition 3).

Note that status A, status B, and status C shown in FIG. 5A represent the following statuses:

Status A) the water phase thickness ratio $h_r=0.50$ in a case where the viscosity ratio $\eta_r=1$ and the flow rate ratio $Q_r=1$;

Status B) the water phase thickness ratio $h_r=0.39$ in a case where the viscosity ratio $\eta_r=10$ and the flow rate ratio $Q_r=1$; and Status C) the water phase thickness ratio $h_r=0.12$ in a case where the viscosity ratio $\eta_r=10$ and the flow rate ratio $Q_r=10$.

Figure 5B:
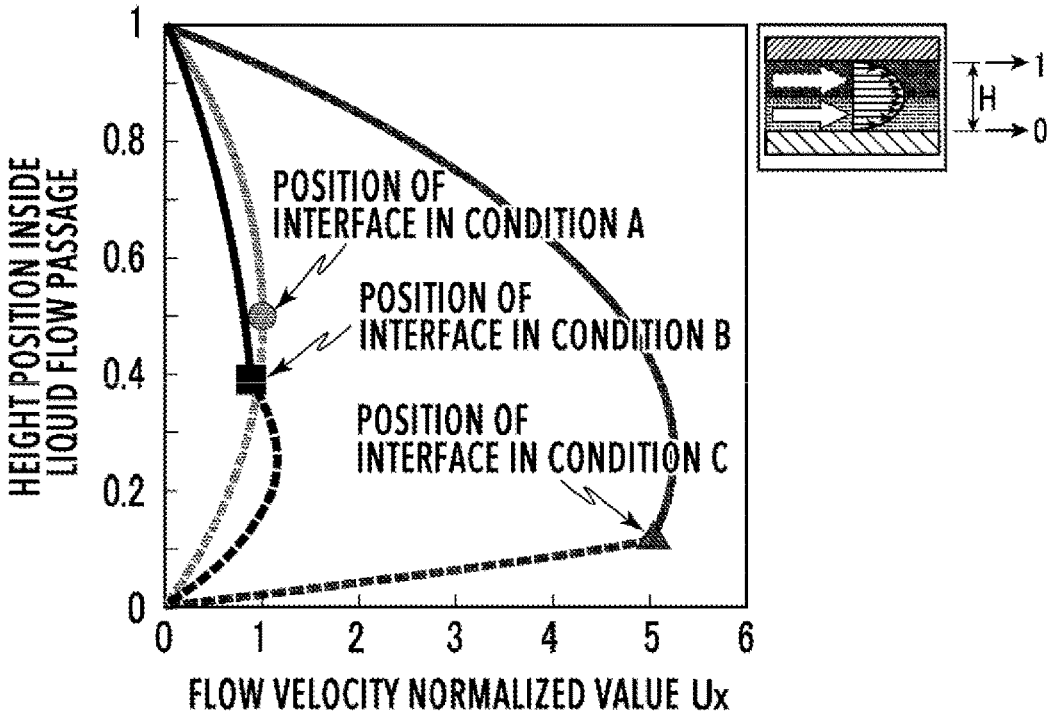

FIG. 5B is a graph showing flow velocity distribution in the height direction (the z direction) of the liquid flow passage 13 (the pressure chamber) regarding the above-mentioned statuses A, B, and C, respectively. The horizontal axis indicates a normalized value Ux which is normalized by defining the maximum flow velocity value in the status A as 1 (a criterion). The vertical axis indicates the height from a bottom surface in the case where the height H of the liquid flow passage 13 (the pressure chamber) is defined as 1 (a criterion). On each of curves indicating the respective statuses, the position of the interface between the first liquid and the second liquid is indicated with a marker. FIG. 5B shows that the position of the interface varies depending on the statuses such as the position of the interface in the status A being located higher than the positions of the interface in the status B and the status C. The reason for this phenomenon is that, in the case where the two types of liquids having different viscosities from each other flow in parallel in the tube while forming the laminar flows, respectively (and forming laminar flows as a whole), the interface between those two liquids is formed at a position where a difference in pressure attributed to the difference in viscosity between the liquids balances a Laplace pressure attributed to the interfacial tension.

(Flows at Liquid-Liquid Interface During Ejection)

As the first liquid and the second liquid flow severally, a liquid level (the liquid-liquid interface) is formed at a position corresponding to the viscosity ratio $\eta_r$ and the flow rate ratio $Q_r$ therebetween (corresponding to the water phase thickness ratio $h_r$). If the liquids are successfully ejected from the ejection port 11 while maintaining the position of the interface, then it is possible to achieve a stable ejection operation. The following are two possible configurations for achieving the stable ejection operation:

Configuration 1: a configuration to eject the liquids in a state where the first liquid and the second liquid are flowing; and Configuration 2: a configuration to eject the liquids in a state where the first liquid and the second liquid are at rest.

The configuration 1 makes it possible to eject the liquids stably while maintaining the given position of the interface. This is due to a reason that an ejection velocity (several meters per second to more than ten meters per second) of a droplet in general is faster than flow velocities (several millimeters per second to several meters per second) of the first liquid and the second liquid, and the ejection of the liquids is affected little even if the first liquid and the second liquid are kept flowing during the ejection operation.

In the meantime, the status 2 also makes it possible to eject the liquids stably while maintaining the given position of the interface. This is due to a reason that the first liquid and the second liquid are not mixed immediately due to a diffusion effect on the liquids on the interface, and an unmixed state of the liquids is maintained for a very short period of time. During a period of several tens of microseconds at a general inkjet driving frequency in a case where a low-molecular material in water has a typical diffusion coefficient of $D=10^{-9}$ $m^2/s$, the liquids are diffused in a distance of only 0.2 to 0.3 μm. Accordingly, the interface is maintained in the state where the flows of the liquids are stopped to rest immediately before ejecting the liquids. Thus, it is possible to eject the liquid while maintaining the position of the interface therebetween.

However, the configuration 1 is preferable because this configuration can reduce adverse effects of mixture of the first and second liquids due to the diffusion of the liquids on the interface and because it is not necessary to conduct advanced control for flowing and stopping the liquids.

(Ejection Modes of Liquids)

A percentage of the first liquid contained in droplets ejected from the ejection port (ejected droplets) can be changed by adjusting the position of the interface (corresponding to the water phase thickness ratio $h_r$). Such ejection modes of the liquids can be broadly categorized into two modes depending on types of the ejected droplets:

Mode 1: a mode of ejecting only the second liquid; and

Mode 2: a mode of ejecting the second liquid inclusive of the first liquid.

The mode 1 is effective, for example, in a case of using a liquid ejection head of a thermal type that employs an electrothermal converter (a heater) as the pressure generating element 12, or in other words, in a case of using a liquid ejection head that utilizes a bubbling phenomenon that depends heavily on properties of a liquid. This liquid ejection head is prone to destabilize bubbling of the liquid due to a scorched portion of the liquid developed on a surface of the heater. The liquid ejection head also has a difficulty in ejecting some types of liquids such as non-aqueous inks. However, if a bubbling agent that is suitable for bubble generation and is less likely to develop scorch on the surface of the heater is used as the first liquid and any of functional agents having a variety of functions is used as the second liquid by adopting the mode 1, it is possible to eject the liquid such as a non-aqueous ink while suppressing the development of the scorch on the surface of the heater.

The mode 2 is effective for ejecting a liquid such as a high solid content ink not only in the case of using the liquid ejection head of the thermal type but also in a case of using a liquid ejection head that employs a piezoelectric element as the pressure generating element 12. To be more precise, the mode 2 is effective in the case of ejecting a high-density pigment ink having a large content of a pigment being a coloring material onto a printing medium. In general, by increasing the density of the pigment in the pigment ink, it is possible to improve chromogenic properties of an image printed on a printing medium such as plain paper by use of the high-density pigment ink. Moreover, by adding a resin emulsion (resin EM) to the high-density pigment ink, it is possible to improve abrasion resistance and the like of a printed image owing to the resin EM formed into a film. However, an increase in solid component such as the pigment and the resin EM tends to develop agglomeration at a close interparticle distance, thus causing deterioration in dispersibility. Accordingly, it is difficult to disperse each of the pigment and the resin EM into the ink at a high density. The pigment is especially harder to disperse than the resin EM. For this reason, the pigment and the resin EM have heretofore been dispersed by reducing the amount of one of them. To be more precise, the pigment and the resin EM have been dispersed by setting ratios of the pigment and the resin EM contained in the ink, for example, to 4 wt % and 15 wt % or to 8 wt % and 4 wt %, respectively.

However, by adopting the above-described mode 2, it is possible to use the high-density resin EM ink as the first liquid and to use the high-density pigment ink as the second liquid. In this way, each of the pigment ink and the resin EM ink can be ejected at a high density. As a consequence, it is possible to deposit the high-density pigment ink and the high-density resin EM ink on the printing medium, thereby printing a high-quality image that can be hardly achievable with a single ink, or in other words, an image with good chromogenic properties, excellent abrasion resistance, and the like. Specifically, the use of the mode 2 makes it possible to deposit the high-density pigment at a density in a range from 8 to 12 wt % and the high-density resin EM at a density in a range from 15 to 20 wt %, for example, on the printing medium, respectively.

(Configuration of Confluence Unit on Inflow Side)

Figure 6A:
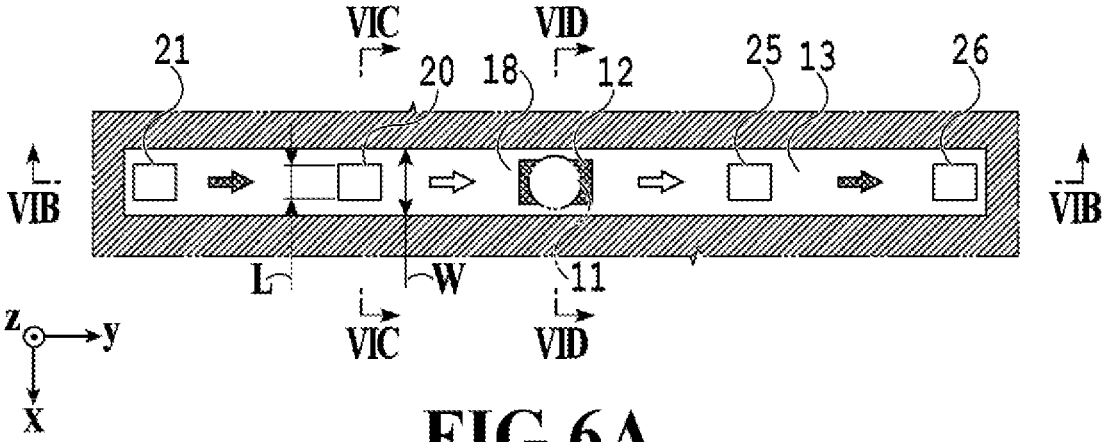
FIGS. 6A to 6D are drawings showing a liquid flow passage and a pressure chamber formed in an element board of a comparative example.
Figure 6B:
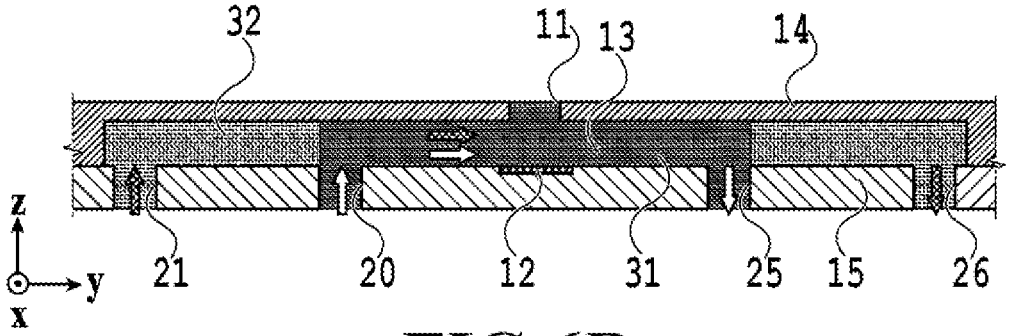
Figure 6C:
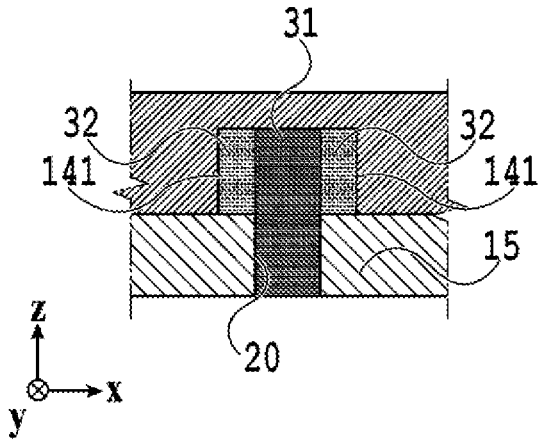
Figure 6D:
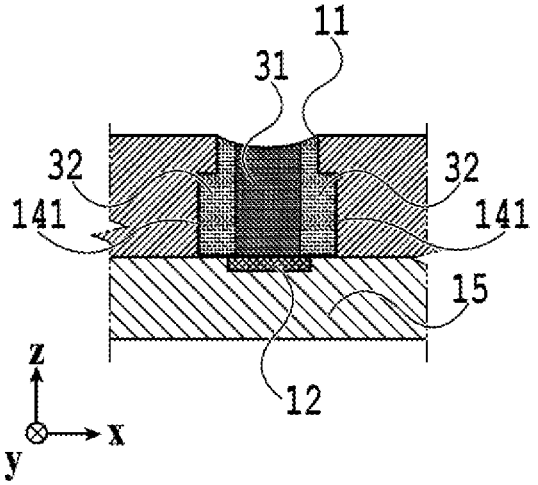

FIGS. 6A to 6D are diagrams showing one liquid flow passage 13 and one pressure chamber 18 formed in the element board 10. FIGS. 6A to 6D represent a comparative example in which the liquid-liquid interface is formed such that the first liquid and the second liquid are arranged in the x direction in the pressure chamber 18. FIG. 6A is a perspective view from the ejection port 11 side (from the +z direction side) and FIGS. 6B to 6D are cross-sectional views taken along the VIB-VIB line, the VIC-VIC line, and the VID-VID line in FIG. 6A, respectively.

A length of the first inflow port 20 in a direction (hereinafter referred to as a width direction) orthogonal to a direction of flow of the liquids in the pressure chamber 18 (a direction of arrows in FIG. 6A) and to a direction from the pressure generating element 12 to the ejection port 11 (a height direction) will be defined as L. Meanwhile, a length in the width direction of the liquid flow passage 13 will be defined as W. As shown in FIG. 6A, the length L of the first inflow port 20 is shorter than the length W of the liquid flow passage 13 and a relation of L<W holds true (see FIG. 6A). In the case of this configuration, as shown in FIG. 6C, the first liquid 31 flows from the first inflow port 20 into a central region in the width direction of the liquid flow passage 13 while the second liquid 32 flows along wall surfaces 141 constituting the liquid flow passage 13, which are located on the right and left in the direction of flow of the liquids in the liquid flow passage 13.

Figure 7A:
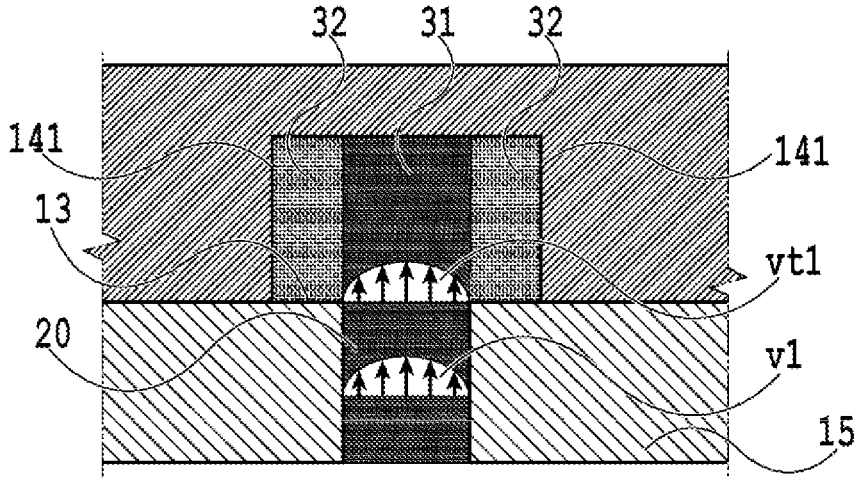
FIGS. 7A and 7B are diagrams for explaining velocity distribution of a liquid in the liquid flow passage.

FIG. 7A is a diagram which shows vectors of velocity distribution of the first liquid 31 in the same cross-sectional view as FIG. 6C. At the first inflow port 20, velocity distribution v1 of the first liquid 31 has such distribution that the velocity of the liquid is zero at a wall surface of the first inflow port 20 and is maximal at the central part of the first inflow port 20. The velocity distribution v1 of the first liquid 31 in the z direction turns into velocity distribution vt1 after the first liquid 31 is discharged from the first inflow port 20.

Figure 7B:
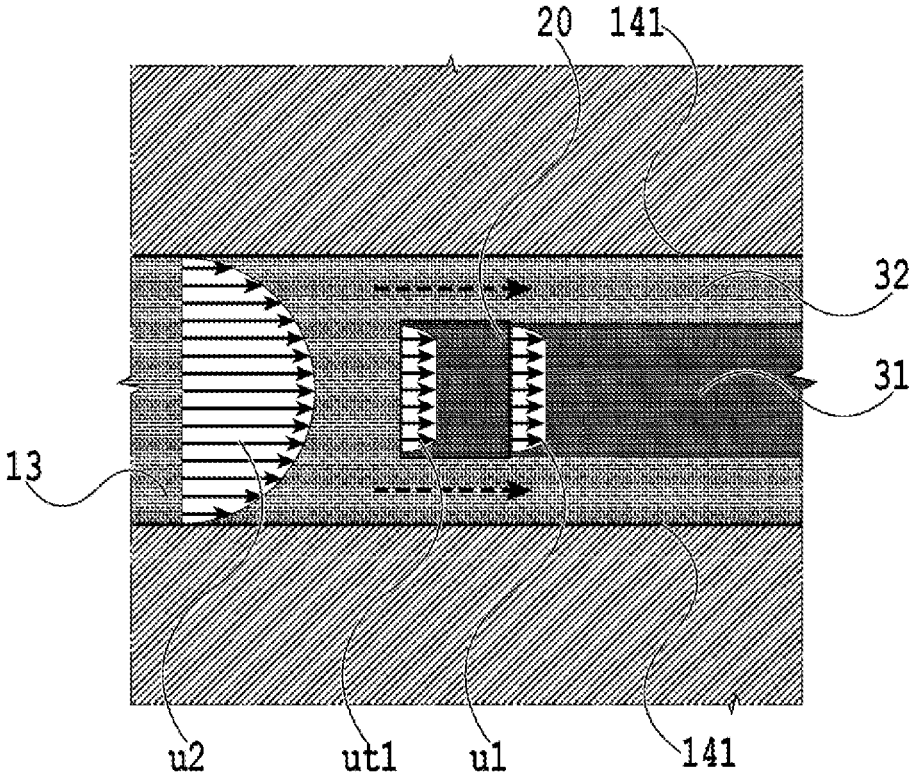

FIG. 7B is an enlarged diagram in the vicinity of the first inflow port 20 of FIG. 6A, which is a diagram showing vectors of velocity distribution of the first liquid 31 and of velocity distribution of the second liquid 32 in the liquid flow passage 13. The velocity distribution vt1 of the first liquid 31 discharged from the first inflow port 20 turns into velocity distribution ut1 in the liquid flow passage 13, and the first liquid 31 having been subjected to the change into the velocity distribution ut1 flows in the liquid flow passage 13. As described above, the velocity distribution of the first liquid 31 is changed at a bent portion where the first inflow port 20 is coupled to the liquid flow passage 13.

In the meantime, the second liquid 32 is in a state of velocity distribution u2 on an upstream side of the first inflow port 20 in the liquid flow passage 13 in the direction of flow of the liquids. The second liquid 32 having the velocity distribution u2 joins the first liquid 31 having velocity distribution u1. The first liquid 31 in the liquid flow passage 13 is less likely to flow between each wall surface 141 of the liquid flow passage 13 and the first inflow port 20. Hence, the second liquid 32 flows between each wall surface 141 and the first inflow port 20. For this reason, the second liquid 32 flows in such a way as to sandwich the first liquid 31. Accordingly, it is more likely that the liquid-liquid interface is formed in such a way as to arrange the first liquid 31 and the second liquid 32 in the horizontal direction (the width direction) in the liquid flow passage 13.

The second liquid 32 and the first liquid 31 flow to the pressure chamber 18 while maintaining the state in which the liquid-liquid interface is formed in such a way as to arrange the first liquid 31 and the second liquid 32 in the horizontal direction (the width direction) of the liquid flow passage 13. In other words, the first liquid 31 and the second liquid 32 do not form parallel flows that are stacked in the height direction of the liquid flow passage 13.

In the case where the liquid-liquid interface is formed as shown in FIG. 6C, the first liquid 31 flows above the pressure generating element 12 in the pressure chamber 18 in such a way as to substantially occupy an area from the pressure generating element 12 to the ejection port 11 as shown in FIG. 6D. In this way, the liquid to be ejected is substantially composed of the first liquid 31 and it is therefore difficult to principally eject the second liquid 32 that is necessary to achieve the printing.

Figure 8A:
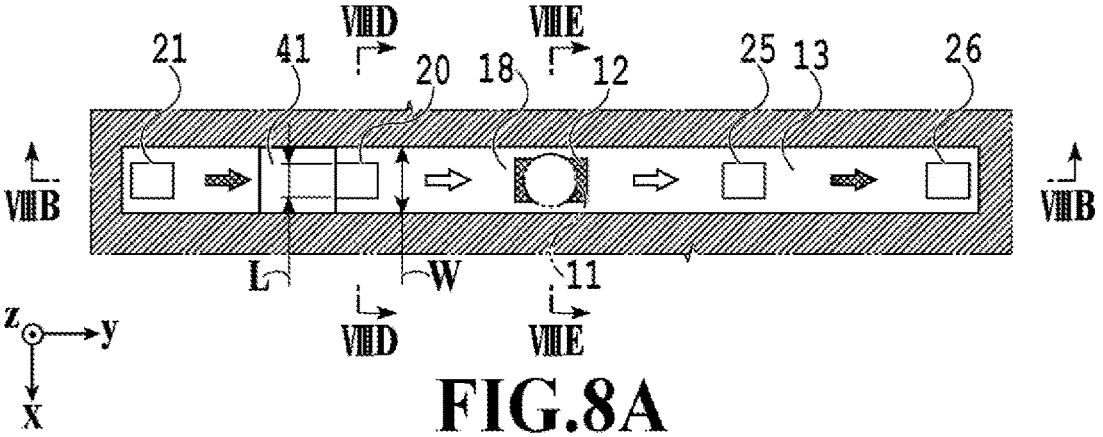
FIGS. 8A to 8E are drawings showing the liquid flow passage and the pressure chamber for explaining a confluence wall.
Figure 8B:
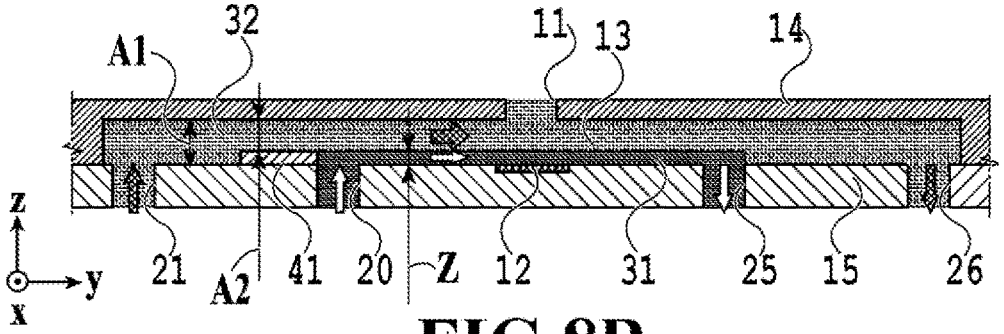
Figure 8C:
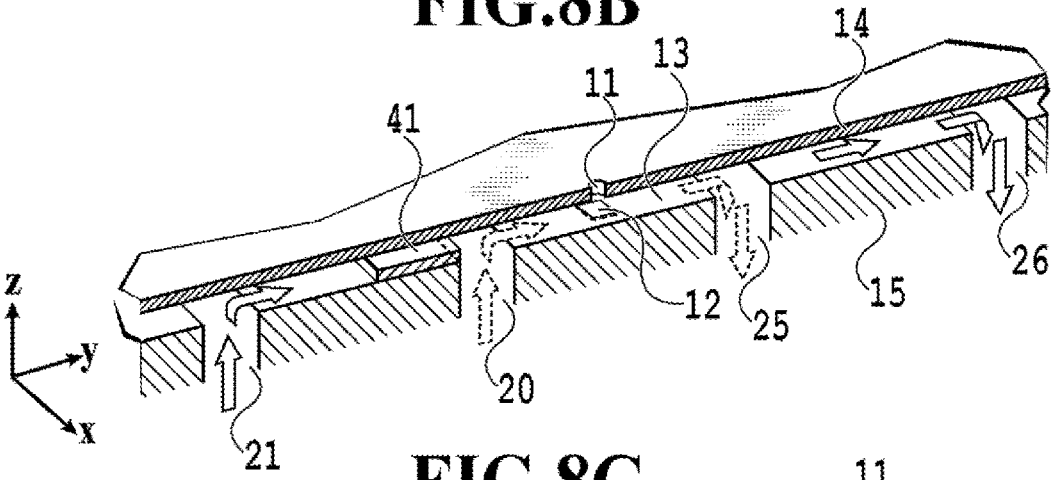
Figure 8D:
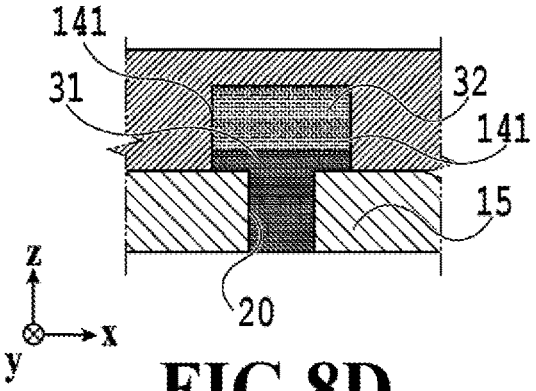
Figure 8E:
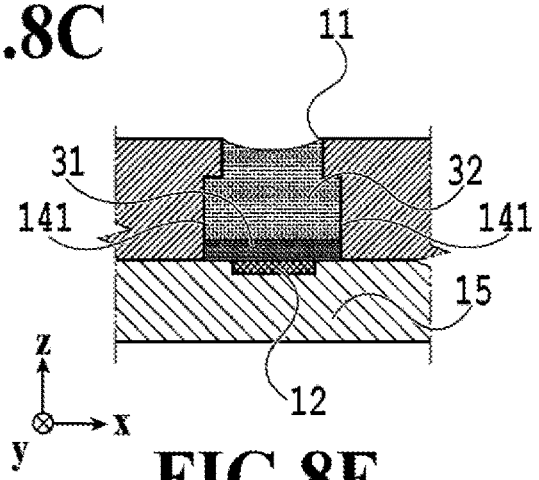

FIGS. 8A to 8E are diagrams for explaining the one liquid flow passage 13 and the one pressure chamber 18 formed in the element board 10 of this embodiment. FIG. 8A is a perspective view from the ejection port 11 side (from the +z direction side) and FIG. 8B is a cross-sectional view taken along the VIIIB-VIIIB line in FIG. 8A. FIG. 8C is an enlarged diagram of the neighborhood of one of the liquid flow passages 13 in the element board of this embodiment. Moreover, FIGS. 8D and 8E are cross-sectional views taken along the VIIID-VIIID line and the VIIIE-VIIIE line in FIG. 8A, respectively. As with FIG. 6A, FIG. 8A shows a configuration in which the dimension L in the width direction of the first inflow port 20 is shorter than the length W in the width direction of the liquid flow passage 13 (L<W).

A confluence wall 41 is provided on a surface (a surface that comes into contact with the liquid) of the substrate 15 on the upstream side of the first inflow port 20 in the direction of flow of the liquids (the y direction) in the liquid flow passage 13. The confluence wall 41 is provided so as to project from the surface of the substrate 15. The confluence wall 41 is a wall having a portion located at a higher position than the surface of the substrate 15 on the downstream side of the first inflow port 20 in the direction of flow of the liquids. The expression "having a portion located at a higher position" means that the entire confluence wall 41 does not always have to be located higher than the surface of the substrate 15 on the downstream side of the first inflow port 20 in the direction of flow of the liquids. In other words, the confluence wall 41 is a wall located on the upstream side in the y direction (which is the left side in FIG. 8B) viewed from the first liquid 31 at a bent portion where the first inflow port 20 is joined to the liquid flow passage 13. Due to the presence of the confluence wall 41, the second liquid 32 is guided to flow at a higher position (in the +z direction) than the first liquid 31 at a confluence unit for the first liquid 31 and the second liquid 32.

Figure 9A:
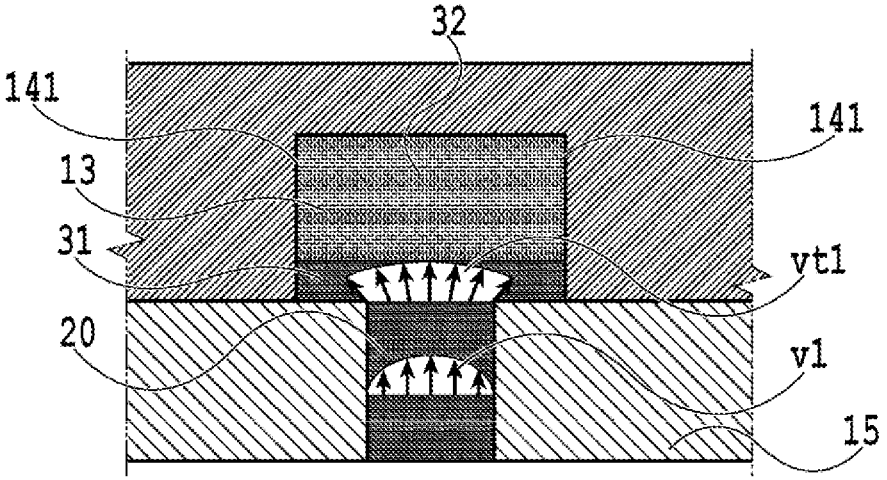
FIGS. 9A and 9B are diagrams for explaining velocity distribution of a liquid in the liquid flow passage.

FIG. 9A is a diagram which shows vectors of velocity distribution of the first liquid 31 in the same cross-sectional view as FIG. 8D. At the first inflow port 20, the velocity distribution v1 of the first liquid 31 has such distribution that the velocity of the liquid is zero at the wall surface of the first inflow port 20 and is maximal at the central part of the first inflow port 20. The velocity distribution v1 of the first liquid 31 turns into the velocity distribution vt1 after the first liquid 31 having the flow with the velocity distribution v1 is discharged from the first inflow port 20. Due to an influence of the confluence wall 41, the second liquid 32 is guided to flow at the higher position than the first liquid 31. For this reason, the velocity distribution vt1 of the first liquid 31 in the liquid flow passage 13 of this embodiment has such distribution that the flow spreads in a direction toward the wall surfaces 141 of the liquid flow passage 13 at the position lower than the confluence wall 41.

Figure 9B:
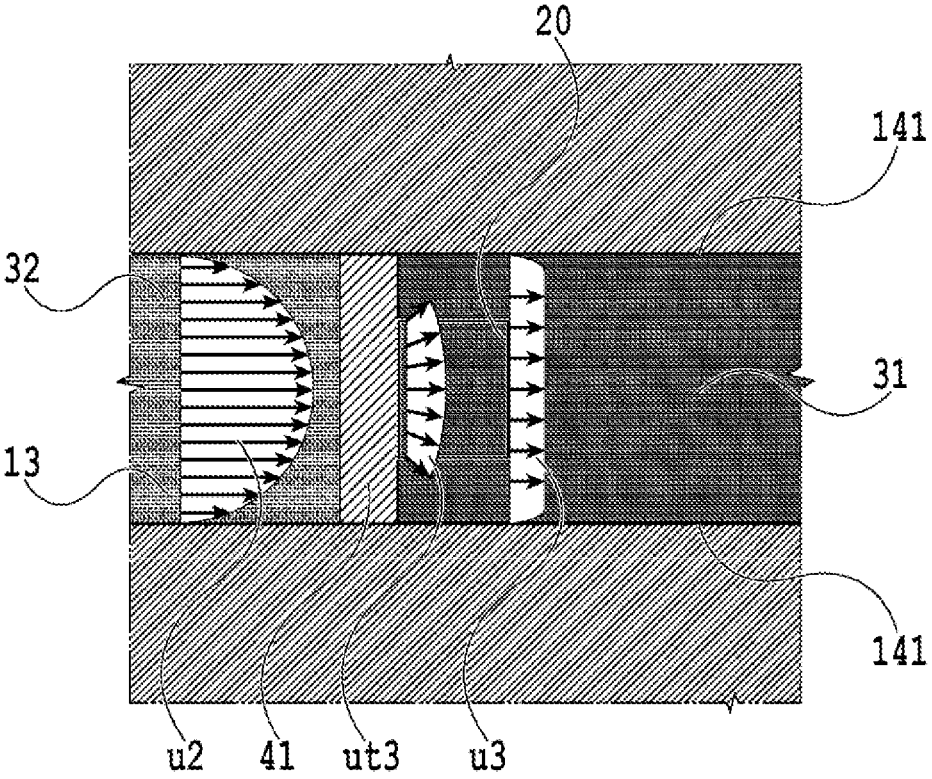

FIG. 9B is an enlarged diagram in the vicinity of the first inflow port 20 of FIG. 8A, which is a diagram showing vectors of velocity distribution of the first liquid 31 and of velocity distribution of the second liquid 32 in the liquid flow passage 13 of this embodiment. Due to the presence of the confluence wall 41 in the liquid flow passage 13, the first liquid 31 having velocity distribution ut3 that is prone to spread over the entire liquid flow passage 13 flows at the bent portion of this embodiment where the first inflow port 20 is joined to the liquid flow passage 13. Moreover, since the confluence wall 41 is provided in the liquid flow passage 13, the second liquid 32 flowing from the upstream side flows on the confluence wall 41. For this reason, the second liquid 32 having the velocity distribution u2 is less likely to flow between each wall surface 141 of the liquid flow passage 13 and the first inflow port 20 in the −z direction from the confluence wall 41. As a consequence, the above-mentioned first liquid 31 prone to spread over the entire liquid flow passage 13 at the bent portion turns into a flow having velocity distribution u3 that flows while spreading over the entire liquid flow passage 13 at an end portion on the downstream side of the first inflow port 20.

For this reason, in this embodiment, it is possible to stably form such a liquid-liquid interface that arranges the first liquid 31 and the second liquid 32 in the height direction of the liquid flow passage 13. Thus, in the pressure chamber 18 of this embodiment, the first liquid 31 flows on the pressure generating element 12 side and the second liquid 32 flows on the ejection port 11 side. As a consequence, in the case where the bubbling medium is used for the first liquid 31 and a printing medium having functions necessary for print formation is used for the second liquid 32, the second liquid 32 necessary for print formation can be mainly ejected from the ejection port.

In particular, a larger length in the height direction (a distance Z in FIG. 8B) of the confluence wall 41 is more effective in order to achieve the liquid-liquid interface that arranges the first liquid 31 and the second liquid 32 in the height direction of the liquid flow passage 13. In the meantime, a length A2 in the height direction of the liquid flow passage on the confluence wall 41 where the second liquid 32 flows becomes smaller than a length A1 in the height direction of a portion of the liquid flow passage without provision of the confluence wall 41. Accordingly, as the length Z in the height direction of the confluence wall 41 becomes longer, a pressure loss of the second liquid 32 flowing on the confluence wall 41 is increased, thus complicating the supply of the second liquid 32. Particularly in the case where the printing medium having the functions necessary for print formation is used for the second liquid 32 and water as the bubbling medium is used for the first liquid 31 so as to stably eject the second liquid 32, the second liquid 32 has a higher viscosity than that of the first liquid 31. Given the situation, it is preferable to set the height of the second liquid 32 on the confluence wall equal to or below a half of the height of the liquid flow passage.

Meanwhile, as shown in FIG. 8A, a length in the width direction of the confluence wall 41 is equivalent to the length W in the width direction of the liquid flow passage 13 in this embodiment. However, this disclosure is not limited to this configuration. The length in the width direction of the confluence wall 41 may be shorter than the length W in the width direction of the liquid flow passage 13. However, in order to form the liquid-liquid interface that arranges the first liquid 31 and the second liquid 32 in the height direction of the liquid flow passage 13, it is preferable to set the length in the width direction of the confluence wall 41 equivalent to the length W in the width direction of the liquid flow passage 13. Here, the equivalence means that if the length W in the width direction of the liquid flow passage 13 is 1, then the length in the width direction of the confluence wall 41 is in a range from 0.9 to 1.0.

Here, the confluence wall 41 may be formed from part of the substrate 15 (such as silicon in the silicon substrate or a film on the silicon substrate) or formed from a material different from the substrate 15 (such as a resin layer and a metal layer).

Figure 10A:
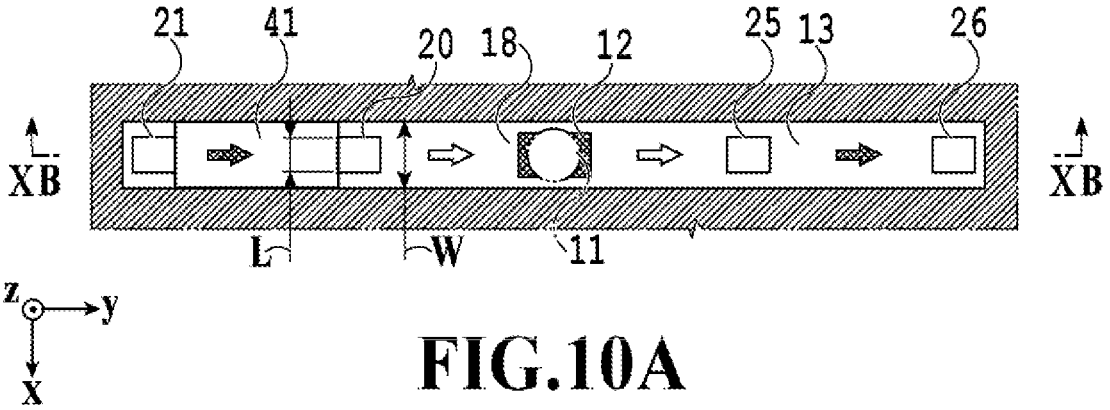
FIGS. 10A to 10C are drawings showing the liquid flow passage and the pressure chamber for explaining the confluence wall.
Figure 10B:
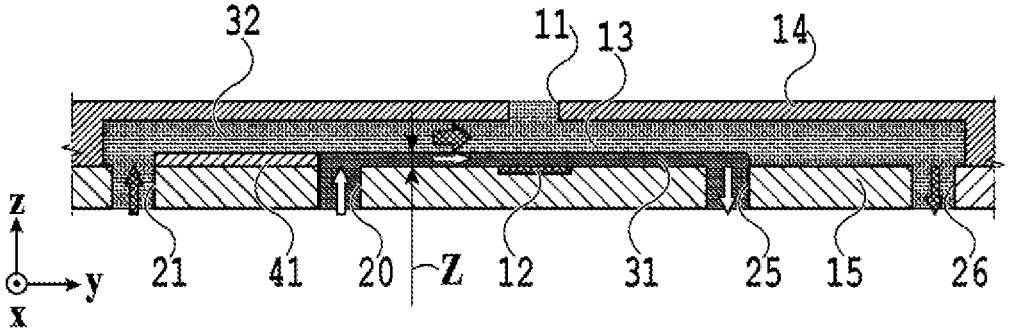
Figure 10C:
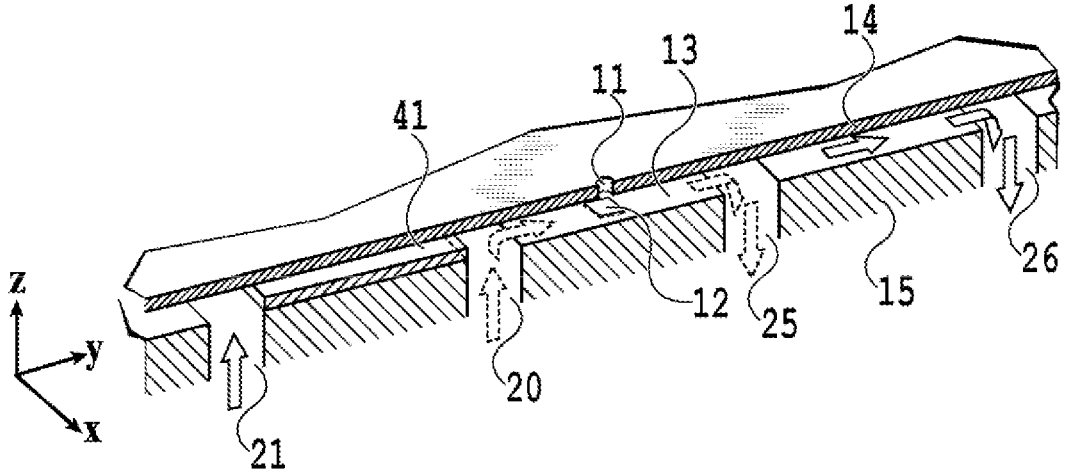

FIGS. 10A to 10C are diagrams for explaining another example of the confluence wall 41. FIG. 10A is a perspective view from the ejection port 11 side (from the +z direction side) and FIG. 10B is a cross-sectional view taken along the XB-XB line in FIG. 10A. FIG. 10C is an enlarged diagram of the neighborhood of one of the liquid flow passages 13 in the element board of this embodiment. The confluence wall 41 may be configured to extend continuously on a portion of the substrate 15 from a position above an open end on the upstream side of the first inflow port 20 in the direction of flow of the liquids in the liquid flow passage 13 to a position above an open end on the downstream side of the second inflow port 21 in the direction of flow of the liquids in the liquid flow passage 13.

Figure 11A:
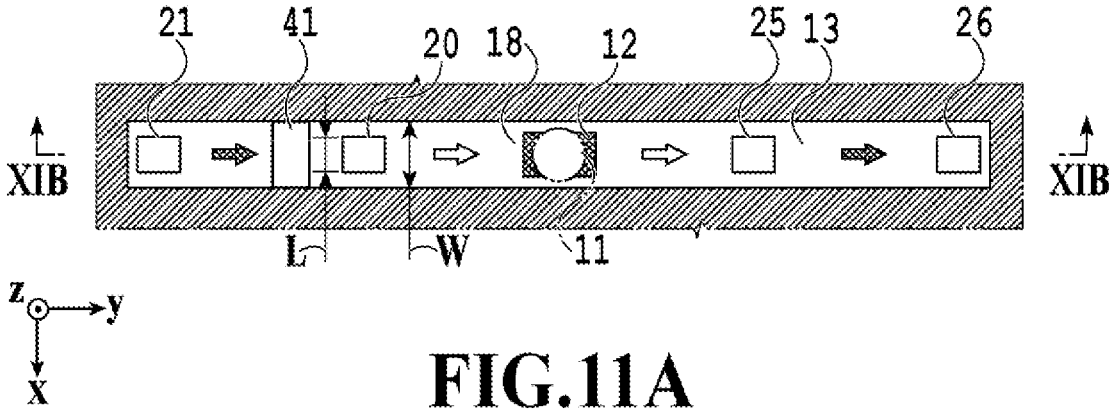
FIGS. 11A and 11B are diagrams for explaining a clearance of the confluence wall.
Figure 11B:
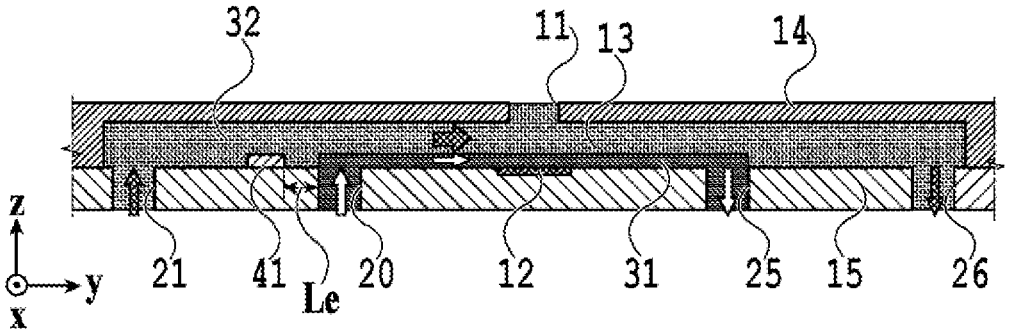

FIGS. 11A and 11B are diagrams for explaining a position of the confluence wall 41 on the substrate 15. FIG. 11A is a perspective view from the ejection port 11 side (from the +z direction side) and FIG. 11B is a cross-sectional view taken along the XIB-XIB line in FIG. 11A.

A distance from an end portion on the downstream side of the confluence wall 41 in the direction of flow of the liquids (the y direction) in the liquid flow passage 13 to the open end on the upstream side of the first inflow port 20 in the direction of flow of the liquids in the liquid flow passage 13 will be defined as a clearance Le. The clearance Le of the confluence wall 41 preferably satisfies the following relation:

$$Le \leq (0.550Re + 0.379\exp(-0.148Re) + 0.260) \times De \quad \text{(formula 3)},$$

where Re: the Reynolds number;

De: an equivalent diameter (4Af/Wp);

Af: a cross-sectional area of the flow passage; and

Wp: a length of a wet edge.

The formula 3 is a formula obtained based on an inlet length which is required for a complete development of a flow of the liquid in the case where the liquid flows into a pipeline like the liquid flow passage 13. In terms of a general inkjet printing head, the cross-sectional area of the flow passage is Af=224 $\mu m^2$, the length of the wet edge is Wp=60 μm, and the equivalent diameter De is about 14.9 μm. Accordingly, in the case where the Reynolds number Re is in a range from 0.1 to 1.0, the value on the right side of the formula 3 is equivalent to more than ten micrometers. For this reason, the clearance Le of the first inflow port is preferably set to Le=0 or Le≈0, or in other words, the end portion on the downstream side of the confluence wall 41 in the direction of flow of the liquids in the liquid flow passage 13 is preferably located on the open end on the upstream side of the first inflow port 20 in the direction of flow of the liquids in the liquid flow passage 13.

In the case where the clearance Le does not satisfy the formula 3, the flow of the second liquid 32 flowing into the region of the clearance Le spreads in the directions towards the wall surfaces 141 of the liquid flow passage 13 in the region of the clearance Le. For this reason, the flow of the first liquid 31 spreading in the directions of the wall surfaces 141 of the liquid flow passage 13 is blocked by the flow of the second liquid 32. Accordingly, in the case where the clearance Le does not satisfy the formula 3, it is more likely that the liquid-liquid interface that arranges the first liquid 31 and the second liquid 32 in the x direction as shown in FIGS. 6A to 6D will be formed in the pressure chamber 18.

The end portion on the downstream side of the confluence wall 41 in the direction of flow of the liquids in the liquid flow passage 13 described with reference to FIGS. 8A to 8E and 10A to 10C is located on the open end on the upstream side of the first inflow port 20 in the direction of flow of the liquids in the liquid flow passage 13. Accordingly, the confluence wall 41 described with reference to FIGS. 8A to 8E and 10A to 10C is the confluence wall 41 having the clearance Le expressed by Le=0.

Figure 12A:
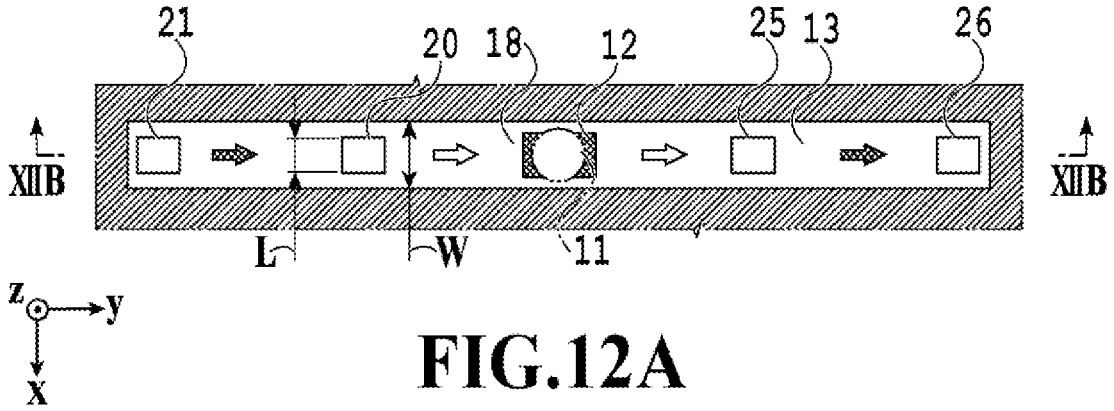
FIGS. 12A to 12C are drawings showing the liquid flow passage and the pressure chamber for explaining an engraved portion.
Figure 12B:
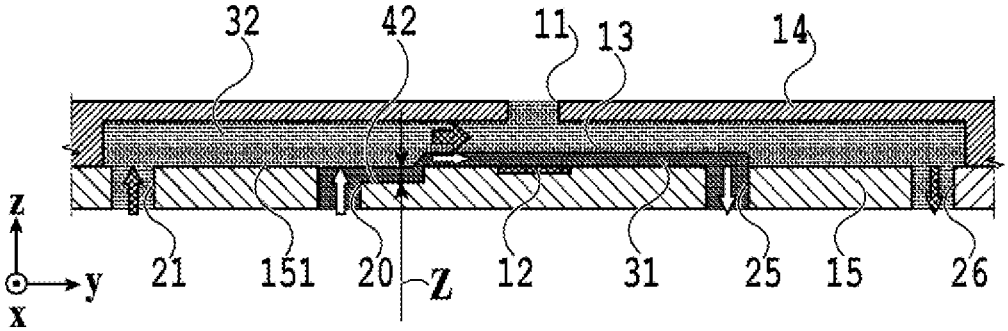
Figure 12C:
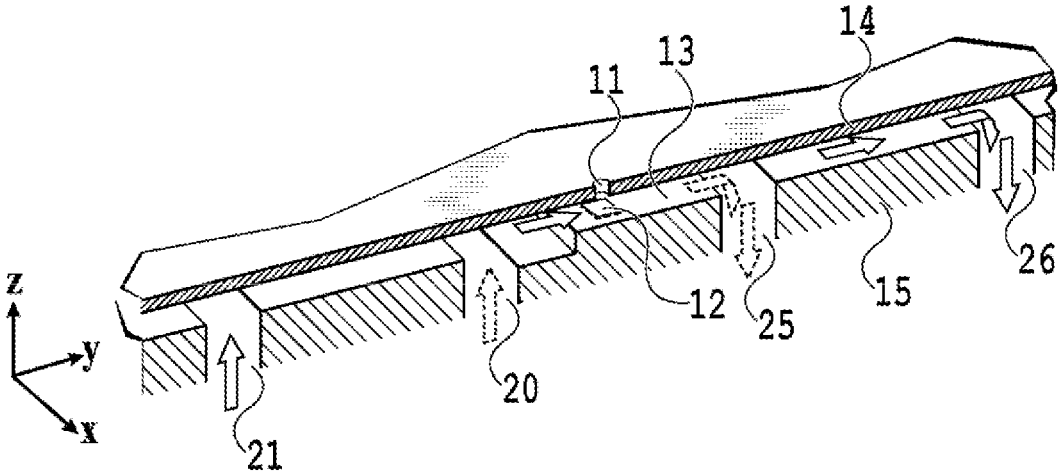

FIGS. 12A to 12C are drawings for explaining an example of providing an engraved portion, which represents another example of providing the confluence wall 41. FIG. 12A is a perspective view from the ejection port 11 side (from the +z direction side) and FIG. 12B is a cross-sectional view taken along the XIIB-XIIB line in FIG. 12A.

The surface of the substrate 15 shown in FIGS. 12A to 12C is provided with an engraved (or removed) portion 42 located on the downstream side of the first inflow port 20 in the direction of flow of the liquids. The engraved portion 42 is formed so as to be located at a position lower by a distance Z in FIG. 12B than a surface 151 of the substrate 15. No engraved portion is provided in the surface 151 on the upstream side of the first inflow port 20 with respect to the direction of flow of the liquids in the liquid flow passage 13. Accordingly, in the liquid flow passage 13, a portion located at a higher position than the surface of the portion of the substrate 15 on the downstream side of the first inflow port 20 in the direction of flow of the liquids is formed on the surface of the substrate 15 on the upstream side of the first inflow port 20 with respect to the direction of flow of the liquids in the liquid flow passage 13. In other words, at a section around the first inflow port 20, the portion on the upstream side in the −y direction is relatively higher by the distance Z than the portion on the downstream side in the +y direction. As a consequence of provision of the engraved portion 42, the portion of the substrate 15 on the upstream side of the first inflow port 20 with respect to the direction of flow of liquids in the liquid flow passage 13 has a similar function as that of the confluence wall. In this case as well, the confluence wall is the wall located on the upstream side in the y direction (on the left side in FIG. 12B) from the viewpoint of the first liquid 31 at the bent portion. For this reason, this configuration can also stably form the liquid-liquid interface that arranges the first liquid 31 and the second liquid 32 in the height direction of the liquid flow passage 13.

Note that the engraved portion 42 can be formed by etching an oxide film of the substrate 15 or dry etching the substrate 15, for example. The engraved portion 42 may be used together with the confluence wall 41 described with reference to FIGS. 10A to 11B.

As described above, according to this embodiment, it is possible to stably form the liquid-liquid interface such that the first liquid 31 and the second liquid 32 flow side by side relative to the height direction (the vertical direction) in the pressure chamber 18. Accordingly, the first liquid 31 comes into contact with the pressure generating element 12 while the second liquid 32 is present on the ejection port side. Thus, it is possible to eject the second liquid 32 by generating a bubble of the first liquid 31 with the pressure generating element 12.

Here, any of the first liquid and the second liquid flowing in the pressure chamber 18 may be circulated between the pressure chamber 18 and an outside unit. If the circulation is not conducted, a large amount of any of the first liquid and the second liquid having formed the parallel flows in the liquid flow passage 13 and the pressure chamber 18 but having not been ejected would come into being. Accordingly, the circulation of the first liquid and the second liquid with the outside units makes it possible to use the liquids that have not been ejected for the purpose of forming the parallel flows again.

(Specific Examples of First Liquid and Second Liquid)

According to the configuration of the embodiment described above, the main functions required in the first liquid and the second liquid are clarified. Specifically, the first liquid may typically be the bubbling medium for developing the film boiling while the second liquid may typically be the ejection medium to be ejected to the atmosphere. The configuration of this embodiment can improve the degree of freedom of components to be contained in the first liquid and the second liquid as compared to the related art. Now, the bubbling medium (the first liquid) and the ejection medium (the second liquid) in this configuration will be described below in detail based on specific examples.

For instance, the bubbling medium (the first liquid) of this embodiment is required to have a high critical pressure to enable development of the film boiling in the media upon heat generation of the electrothermal converter and a rapid growth of the bubble thus generated, or in other words, to enable efficient transformation of thermal energy into bubbling energy. Water is suitable for such a medium in particular. Water has the high boiling point (100° C.) and the high surface tension (58.85 dyne/cm at 100° C.) despite its small molecular weight of 18, and therefore has a high critical pressure of about 22 MPa. In other words, water also exhibits an extremely large bubbling pressure at the time of film boiling. In general, an inkjet printing apparatus adopting the mode of ejecting an ink by use of the film boiling favorably uses an ink prepared by causing water to contain a coloring material such as a dye and a pigment.

Nevertheless, the bubbling medium is not limited to water. Any other substances may function as the bubbling medium as long as such a substance has the critical pressure equal to or above 2 MPa (or preferably equal to or above 5 MPa). Examples of the bubbling medium other than water include methyl alcohol and ethyl alcohol. It is also possible to use a mixture of any of these liquids with water. Meanwhile, it is also possible to use a medium prepared by adding the aforementioned coloring material such as a dye and a pigment, an additive, and the like to water.

On the other hand, the physical properties to enable the film boiling as in the case of the bubbling medium is not required in the ejection medium (the second liquid) of this embodiment, for example. In the meantime, adhesion of a scorched material onto the electrothermal converter (the heater) may deteriorate the bubbling efficiency due to damage on flatness of a heater surface or deterioration in heat conductivity. Nonetheless, the ejection medium does not come into contact directly with the heater and therefore does not bring about any scorched component on the heater. In other words, the ejection medium of this embodiment is exempted from the physical conditions required for developing the film boiling and for avoiding the scorch as the relevant conditions required in a conventional ink for a thermal head, whereby the degree of freedom of the components is improved. As a consequence, the ejection medium can more actively contain components suitable for applications after the ejection.

For example, the pigment that has heretofore been unused because it was easily scorched on the heater may be more actively contained in the ejection medium in this embodiment. In the meantime, a liquid other than an aqueous ink, which has an extremely low critical pressure, can also be used as the ejection medium in this embodiment. Moreover, it is also possible to use various inks having special functions which can hardly be handled by the conventional thermal head, such as an ultraviolet curable ink, an electrically conductive ink, an electron-beam (EB) curable ink, a magnetic ink, and a solid ink, as the ejection media. In the meantime, the liquid ejection head of this embodiment can also be used in various applications other than image formation by using any of blood, cells in culture, and the like as the ejection media. The liquid ejection head is also adaptable to other applications including biochip fabrication, electronic circuit printing, and so forth. Since there are no restrictions regarding the second liquid, the second liquid may adopt the same liquid as one of those cited as the examples of the first liquid. For instance, even if both of the two liquids are inks each containing a large amount of water, it is still possible to use one of the inks as the first liquid and the other ink as the second liquid depending on situations such as a mode of usage.

Second Embodiment

This embodiment describes another mode of the liquid ejection head 1 in which the first liquid 31 and the second liquid 32 flow in the pressure chamber 18 while being stacked on each other in the height direction (the vertical direction). This embodiment will be described while being mainly focused on different features from those of the first embodiment. In this context, the features not specifically mentioned in this embodiment should be regarded the same as those in the first embodiment.

(Relation Between Water Phase Thickness and Confluence Wall)

Figure 13A:
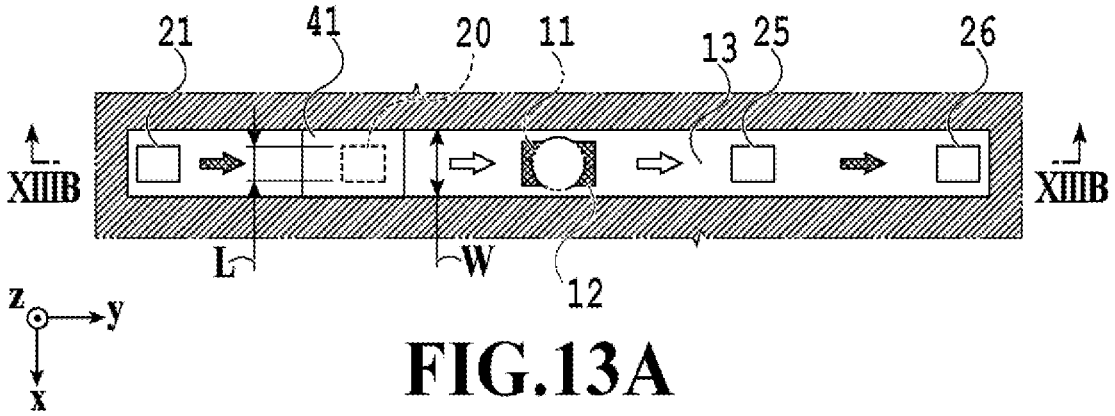
FIGS. 13A to 13C are drawings showing the liquid flow passage and the pressure chamber for explaining the confluence wall.
Figure 13B:
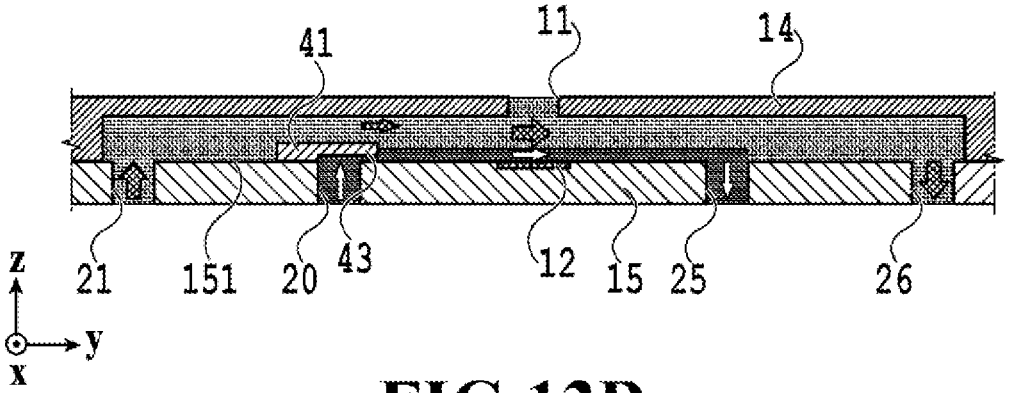
Figure 13C:
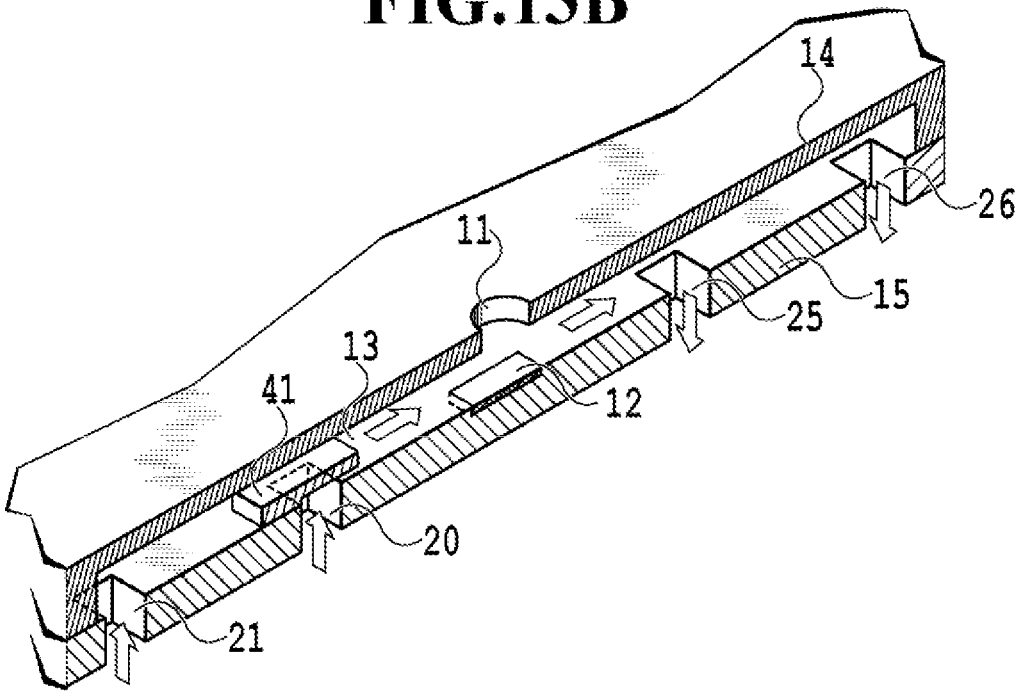

FIGS. 13A to 13C are diagrams showing one liquid flow passage and one pressure chamber 18 formed in the element board 10 of this embodiment. FIG. 13A is a perspective view from the ejection port 11 side (from the +z direction side) and FIG. 13B is a cross-sectional view taken along the XIIIB-XIIIB line in FIG. 13A. Meanwhile, FIG. 13C is an enlarged diagram of the neighborhood of one of the liquid flow passages 13 in the element board.

As shown in FIG. 13B, this embodiment includes the confluence wall 41 provided on the surface 151 of the substrate 15 which comes into contact with the liquid on the upstream side of the first inflow port 20 in the direction of flow of the second liquid 32. The confluence wall 41 is the confluence wall with the clearance Le=0 as shown in FIGS. 8A to 8E.

A characteristic feature of this embodiment is that the confluence wall 41 is provided with a projection 43 that projects downstream in the direction of flow of the liquids. The confluence wall 41 and the projection 43 are integrally formed and the projection 43 is formed to be opposed to the first inflow port 20. Since the confluence wall 41 is provided with the projection 43, it is possible to inhibit the second liquid 32 from flowing into a flow passage between the first inflow port 20 and the projection 43. Accordingly, the first liquid 31 mainly flows in the flow passage between the first inflow port 20 and the projection 43 so as to allow the first liquid 31 and the second liquid 32 to flow in such a way as to be arranged in the height direction even in a flow passage on the downstream side of the projection 43. Note that the length in the width direction of the confluence wall 41 is preferably equal to the length W in the width direction of the liquid flow passage as shown in FIG. 13A.

(Relation Between Water Phase Thickness and Projecting Amount of Projection)

Figure 14A:
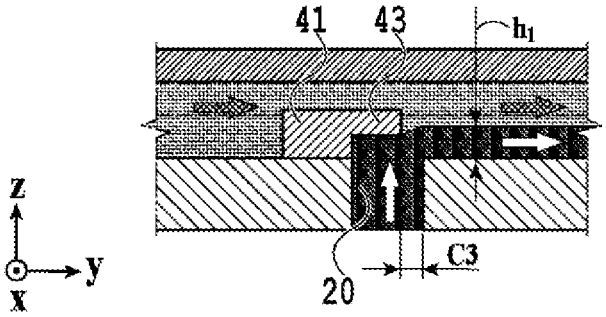
FIGS. 14A to 14E are diagrams for explaining a clearance of the confluence wall and a confluence wall height.
Figure 14B:
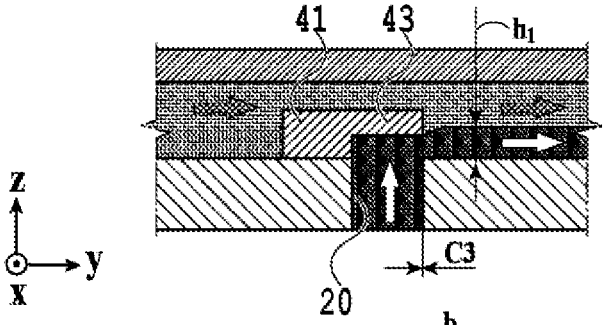
Figure 14C:
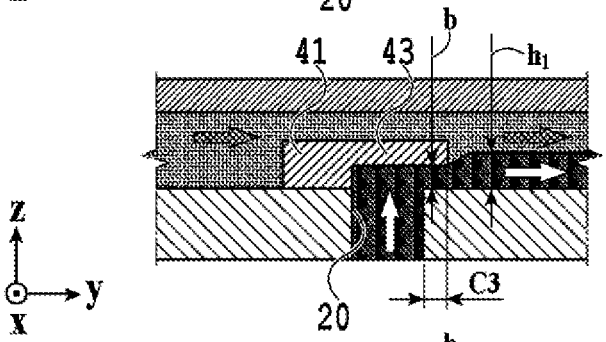

FIGS. 14A to 14C are enlarged diagrams of the neighborhood of the confluence wall 41 in FIG. 13B, which are diagrams for explaining projecting amounts of the projection 43 of the confluence wall 41. A distance between an end portion on the downstream side (the +y direction) of the projection 43 and the open end on the downstream side (the +y direction) of the first inflow port 20 will be defined as a clearance C3. Meanwhile, a clearance in a state where the end portion on the downstream side of the projection 43 is located upstream of the end portion on the downstream side of the first inflow port 20 will be defined as a negative clearance (C3<0).

FIG. 14A is a diagram showing an example of the state where the clearance C3 of the projection 43 is negative (C3<0). In this example, the projection 43 does not cover the entirety of the first inflow port 20. FIG. 14B is a diagram showing an example of the state where the clearance C3 of the projection 43 is equal to zero (C3=0). In this example, the projection 43 entirely covers the first inflow port 20. FIG. 14C is a diagram showing an example of the state where the clearance C3 of the projection 43 is positive (C3>0). In this example, the projection 43 entirely covers the first inflow port 20 and a tip end of the projection 43 reaches a portion of the flow passage on the downstream side of the first inflow port 20.

The state of the clearance C3 equal to or above 0 (C3≥0) representing a configuration to entirely cover the first inflow port 20 is preferable from the viewpoint of forming the liquid-liquid interface such that the first liquid 31 and the second liquid 32 flow in the pressure chamber 18 while being stacked on each other in the vertical direction. In the case where the clearance C3 of the projection 43 is negative (C3<0) as shown in FIG. 14A, the liquid to be ejected is more likely to contain the first liquid 31 as compared to the case where the clearance is equal to or above 0 (C3≥0). However, it is possible to stably eject the second liquid 32. Accordingly, if it is desirable to reduce the amount of the first liquid 31 included in the liquid ejected from the ejection port 11, the projection 43 is formed in such a way as to satisfy the clearance C3 equal to or above 0 (C3≥0). On the other hand, if the liquid ejected from the ejection port 11 needs to contain the first liquid 31, then the projection 43 is formed in such a way as to have the negative clearance C3 (C3<0).

Figure 14D:
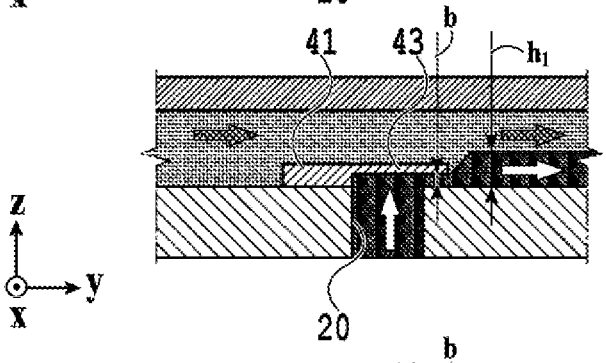
Figure 14E:
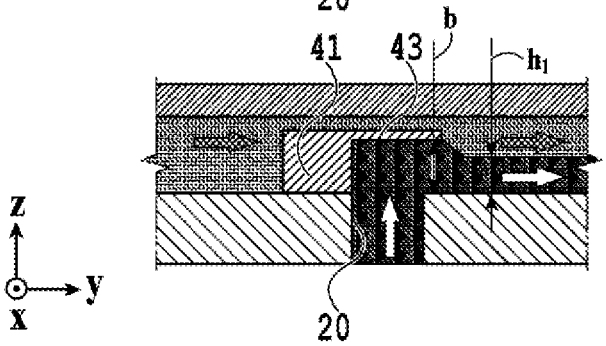

FIGS. 14C to 14E are diagrams for explaining cases of various confluence wall heights b that represent positions in the height direction of the projection 43. FIG. 14C is a diagram showing an example in which the confluence wall height b is substantially equal to a thickness $h_1$ of a phase of the first liquid 31. FIG. 14D is a diagram showing an example in which the confluence wall height b is smaller than the thickness $h_1$ of the phase of the first liquid 31. FIG. 14E is a diagram showing an example in which the confluence wall height b is larger than the thickness $h_1$ of the phase of the first liquid 31.

The water phase thickness $h_r$ is constant in the case where the viscosity ratio and the flow rate ratio are constant. Accordingly, the thickness $h_1$ of the phase of the first liquid 31 maintains a constant thickness as long as the length in the height direction of the liquid flow passage 13 is the same. For this reason, the thicknesses $h_1$ of the phase of the first liquid 31 in the pressure chamber 18 are the same among the configurations of the projection 43 in FIGS. 14C to 14E.

In the case where a printing medium having functions necessary for print formation is used for the second liquid 32 and water serving as the bubbling medium is used for the first liquid 31 so as to enable stable ejection of the second liquid 32, the second liquid 32 has a higher viscosity than that of the first liquid 31. It is preferable to increase the supply of the second liquid 32 in this case. As the confluence wall height b becomes higher, the dimension in the height direction of the upper flow passage 132 located above the confluence wall 41 decreases. Hence, the flow rate of the second liquid 32 flowing on the upper flow passage 132 is limited in this case. Accordingly, a configuration with a short confluence wall height b is preferred in the case of using the printing medium having the functions necessary for print formation for the second liquid 32 and using water serving as the bubbling medium for the first liquid 31.

As described above, this embodiment can also form the liquid-liquid interface such that the first liquid 31 and the second liquid 32 flow in the pressure chamber 18 while being arranged in the height direction (the vertical direction). Accordingly, the first liquid 31 comes into contact with the pressure generating element 12 and the second liquid 32 is present on the ejection port side. As a consequence, it is possible to generate a bubble of the first liquid 31 with the pressure generating element 12 and thus to eject the second liquid 32.

Third Embodiment

This embodiment also uses the liquid ejection head 1 and the liquid ejection apparatus shown in FIGS. 1 to 3.

Figure 15A:
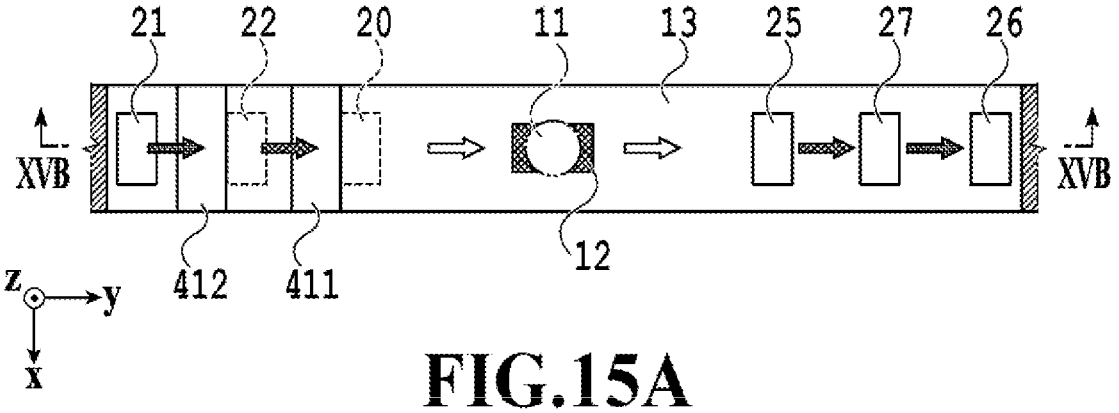
FIGS. 15A to 15C are enlarged detail drawings of the liquid flow passage and the pressure chamber formed in the element board.
Figure 15B:
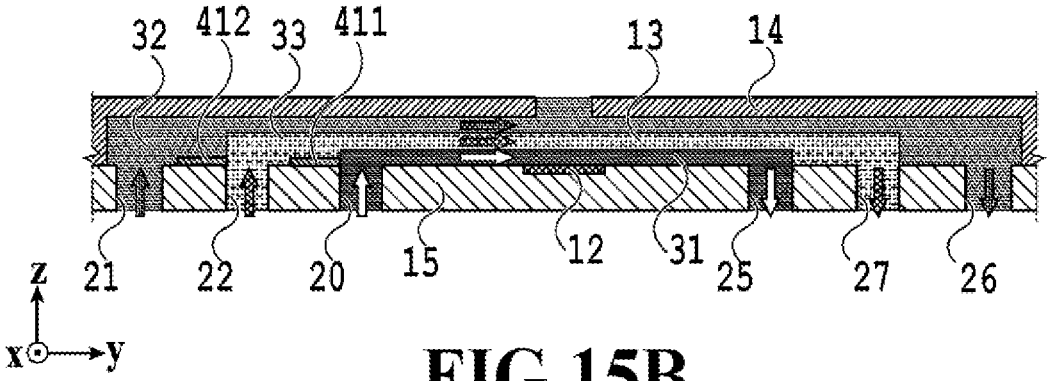
Figure 15C:
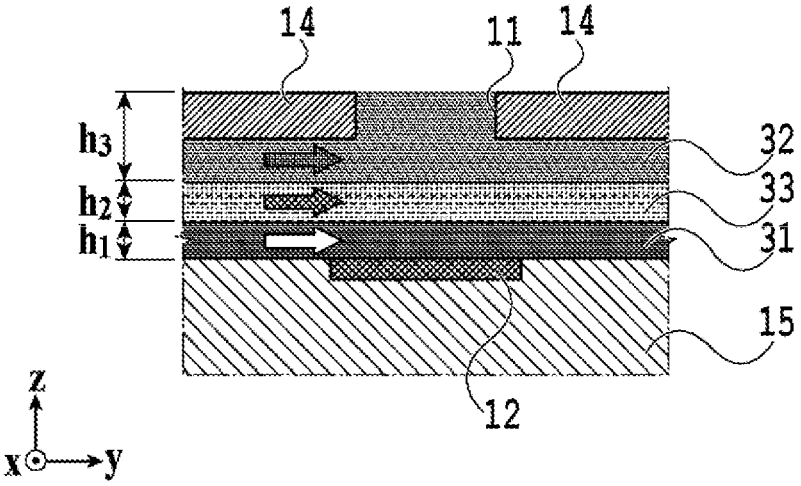

FIGS. 15A to 15C are diagrams showing a configuration of the liquid flow passage 13 of this embodiment. The liquid flow passage 13 of this embodiment is different from the liquid flow passages 13 described in the foregoing embodiments in that a third liquid 33 is allowed to flow in the liquid flow passage 13 in addition to the first liquid 31 and the second liquid 32. By allowing the third liquid to flow in the pressure chamber, it is possible to use the bubbling medium with the high critical pressure as the first liquid while using any of the inks of different colors, the high-density resin EM, and the like as the second liquid and the third liquid.

FIG. 15A is a perspective view from the ejection port 11 side (from the +z direction side) and FIG. 15B is a cross-sectional view taken along the XVB-XVB line in FIG. 15A. In the liquid flow passage 13 of this embodiment, the respective liquids flow in such a way that the third liquid 33 also forms a parallel flow in a state of laminar flow in addition to the parallel flows in the state of laminar flows of the first liquid 31 and the second liquid 32 in the above-described embodiments. In the substrate 15 corresponding to the inner surface (bottom portion) of the liquid flow passage 13, the second inflow port 21, a third inflow port 22, the first inflow port 20, the first outflow port 25, a third outflow port 27, and the second outflow port 26 are formed in this order in the y direction. The pressure chamber 18 including the ejection port 11 and the pressure generating element 12 is located substantially at the center between the first inflow port 20 and the first outflow port 25 in the liquid flow passage 13.

As with the above-described embodiments, the first liquid 31 and the second liquid 32 flow from the first inflow port 20 and the second inflow port 21 into the liquid flow passage 13, then flow in the y direction through the pressure chamber 18, and then flow out of the first outflow port 25 and the second outflow port 26. The third liquid 33 that flows in through the third inflow port 22 is introduced into the liquid flow passage 13, then flows in the liquid flow passage 13 in the y direction, then passes through the pressure chamber 18, and flows out of the third outflow port 27 and is collected. As a consequence, in the liquid flow passage 13, the first liquid 31, the second liquid 32, and the third liquid 33 flow together in the y direction between the first inflow port 20 and the first outflow port 25. In this instance, inside the pressure chamber 18, the first liquid 31 is in contact with the inner surface of the pressure chamber 18 where the pressure generating element 12 is located. Meanwhile, the second liquid 32 forms the meniscus at the ejection port 11 while the third liquid 33 flows between the first liquid 31 and the second liquid 32.

In this embodiment as well, a confluence wall 411 is provided on the portion of the substrate on the upstream side of the first inflow port 20 in the direction of flow of the liquids as with the above-described first embodiment. Moreover, in this embodiment, a confluence wall 412 is provided on a portion of the substrate on the upstream side of the third inflow port 22 in the direction of flow of the liquids. These confluence walls 411 and 412 have the same function as that of the confluence wall 41 of the above-described first embodiment. FIG. 15C is an enlarged diagram of the neighborhood of the pressure chamber in FIG. 15B. Provision of the confluence walls 411 and 412 makes it possible to achieve the laminar flows of the first liquid 31, the second liquid 32, and the third liquid 33 in the vertical direction in the pressure chamber 18. Meanwhile, it is also possible to provide the confluence wall 41 as with the above-described second embodiment. The same applies to a case of causing liquids of four or more types to flow in the form of laminar flows in the liquid flow passage 13.

Other Embodiments

The above-described embodiments are based on the structure in which the length L in the width direction of the first inflow port 20 is smaller than the length W in the width direction of the liquid flow passage 13 (L<W). However, there are also a mode in which the length L in the width direction of the first inflow port 20 is equal to the length W in the width direction of the liquid flow passage 13 (L=W), and a mode in which the length L in the width direction of the first inflow port 20 is larger than the length W in the width direction of the liquid flow passage 13 (L>W). In these modes as well, provision of the confluence wall 41 is effective for forming the liquid-liquid surface such that the first liquid 31 and the second liquid 32 flow in the pressure chamber 18 while being stacked on each other in the height direction.

Figure 16A:
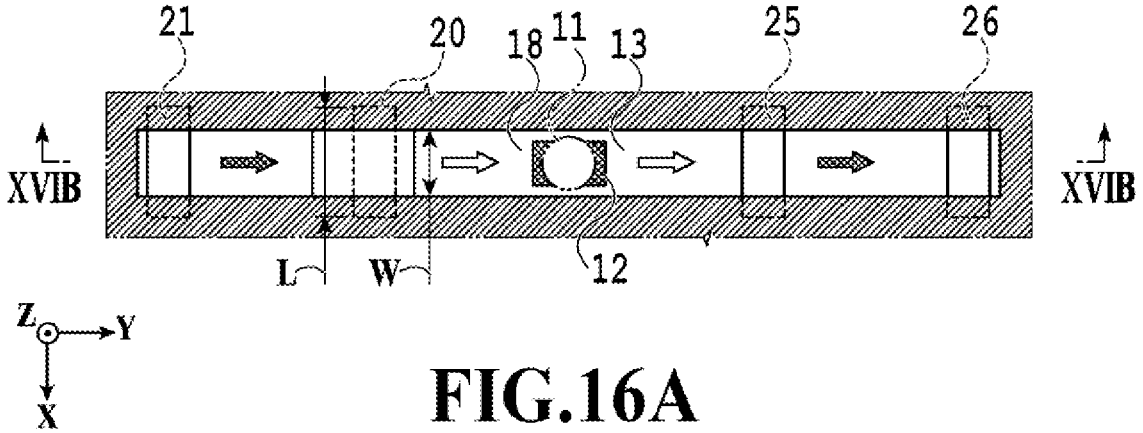
FIGS. 16A and 16B are diagrams showing the liquid flow passage and the pressure chamber formed in the element board.
Figure 16B:
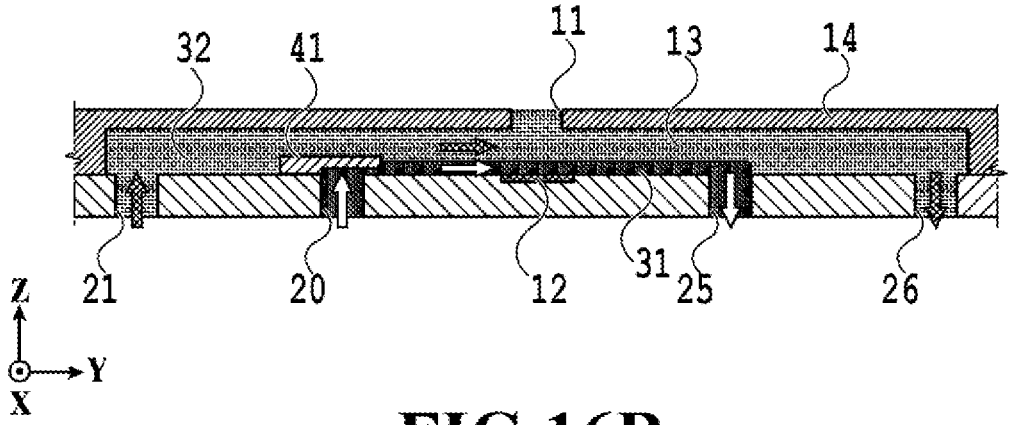

FIGS. 16A and 16B are diagrams showing the above-mentioned mode in which the length L in the width direction of the first inflow port 20 is larger than the length W in the width direction of the liquid flow passage 13 (L>W). FIG. 16A is a perspective view from the ejection port 11 side (from the +z direction side) and FIG. 16B is a cross-sectional view taken along the XVIB-XVIB line in FIG. 16A. Although FIGS. 16A and 16B are the diagrams illustrating the mode of providing the structure that satisfies L>W with the confluence wall 41 and the projection according to the second embodiment, the liquid flow passage may be provided only with the confluence wall 41 as in the first embodiment.

The liquid ejection head and the liquid ejection apparatus including the liquid ejection head according to this disclosure are not limited only to the inkjet printing head and the inkjet printing apparatus configured to eject an ink. The liquid ejection head, the liquid ejection apparatus, and the liquid ejection method of this disclosure are applicable to various apparatuses including a printer, a copier, a facsimile machine equipped with a telecommunication system, and a word processor including a printer unit, and to other industrial printing apparatuses that are integrally combined with various processing apparatuses. In particular, since various liquids can be used as the second liquid, the liquid ejection head, the liquid ejection apparatus, and the liquid ejection method are also adaptable to other applications including biochip fabrication, electronic circuit printing, and so forth.

According to this disclosure, it is possible to stabilize ejection of the liquid serving as the ejection medium by causing the ejection medium and the bubbling medium to flow while being arranged in the height direction in the pressure chamber.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-027392 filed Feb. 19, 2019, and No. 2019-105339 filed Jun. 5, 2019, which are hereby incorporated by reference herein in their entirety.

What is claimed is:

1. A liquid ejection head comprising:

a substrate including a pressure generating element configured to apply pressure to a first liquid;

a member provided with an ejection port configured to eject a second liquid;

a pressure chamber including the ejection port and the pressure generating element; and a liquid flow passage formed by using the substrate and the member, the liquid flow passage including the pressure chamber and allowing at least the first liquid and the second liquid to flow, wherein the substrate includes:

a first inflow port located on an upstream side of the pressure chamber with respect to a direction of flow of the liquids in the liquid flow passage and configured to allow the first liquid to flow into the liquid flow passage, a second inflow port located on an upstream side of the first inflow port and configured to allow the second liquid to flow into the liquid flow passage, and a wall provided between the first inflow port and the second inflow port and having a portion located at a higher position than a surface of the substrate on a downstream side of the first inflow port in the direction of flow of the liquids in the liquid flow passage, in the pressure chamber, the first liquid flows in contact with the pressure generating element and the second liquid flows closer to the ejection port than the first liquid does, and the first liquid flowing in the pressure chamber is circulated between the pressure chamber and an outside unit.

2. The liquid ejection head according to claim 1, wherein the first liquid and the second liquid form laminar flows in the pressure chamber.

3. The liquid ejection head according to claim 1, wherein the first liquid and the second liquid form parallel flows in the pressure chamber.

4. The liquid ejection head according to claim 1, wherein an end portion on the downstream side of the wall is located above an open end on the upstream side of the first inflow port.

5. The liquid ejection head according to claim 1, wherein the wall extends continuously from a position above an open end on the downstream side of the second inflow port to a position above an open end on the upstream side of the first inflow port.

6. The liquid ejection head according to claim 1, wherein the wall projects from a surface of the substrate between the first inflow port and the second inflow port.

7. The liquid ejection head according to claim 1, wherein a height of the wall in a height direction, which is defined as a direction from the pressure generating element toward the ejection port, is a half or less of a height of the liquid flow passage in the height direction.

8. The liquid ejection head according to claim 1, wherein the substrate includes a removed portion located on the downstream side of the first inflow port and formed by removing part of a surface of the substrate, and the wall is a portion of the substrate provided between the first inflow port and the second inflow port and having a surface located at a higher position than the removed portion.

9. The liquid ejection head according to claim 1, wherein the wall includes a projection that projects from the wall to a downstream side.

10. The liquid ejection head according to claim 1, wherein a dimension in a width direction of the liquid flow passage, the width direction being orthogonal to the direction of flow of the liquids in the liquid flow passage and to a direction from the pressure generating element to the ejection port, is shorter than a dimension in the width direction of the first inflow port.

11. The liquid ejection head according to claim 1, wherein a dimension in a width direction of the liquid flow passage, the width direction being orthogonal to the direction of flow of the liquids in the liquid flow passage and to a direction from the pressure generating element to the ejection port, is longer than a dimension in the width direction of the first inflow port.

12. The liquid ejection head according to claim 1, wherein a third liquid flows in the pressure chamber while being in contact with the first liquid and the second liquid.

13. The liquid ejection head according to claim 1, wherein the first liquid has a critical pressure equal to or above 5 MPa.

14. The liquid ejection head according to claim 1, wherein the second liquid is one of a pigment-containing aqueous ink and an emulsion.

15. The liquid ejection head according to claim 1, wherein the second liquid is one of a solid ink and an ultraviolet curable ink.

16. A liquid ejection module for constituting the liquid ejection head according to claim 1, wherein the liquid ejection head is formed by arranging a plurality of liquid ejection modules.

17. A liquid ejection apparatus comprising:

a liquid ejection head according to claim 1;

a control unit configured to control flow of a liquid in a liquid flow passage; and a driving unit configured to drive a pressure generating element.

18. The liquid ejection head according to claim 1, further comprising:

a first outflow port located on a downstream side of the pressure generating element and configured to allow the first liquid to flow out of the liquid flow passage, and a second outflow port located on a downstream side of the first outflow port and configured to allow the second liquid to flow out of the liquid flow passage.

* * * * *